US007077396B2

(12) United States Patent
Uwagaki et al.

(10) Patent No.: US 7,077,396 B2
(45) Date of Patent: Jul. 18, 2006

(54) SHEET FEEDING APPARATUS

(75) Inventors: Hideo Uwagaki, Kyoto (JP); Ryoichi Kawai, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 258 days.

(21) Appl. No.: 10/611,989

(22) Filed: Jul. 3, 2003

(65) Prior Publication Data

US 2004/0004321 A1 Jan. 8, 2004

(30) Foreign Application Priority Data

Jul. 5, 2002 (JP) ..... P2002-197904

(51) Int. Cl.
*B65H 3/52* (2006.01)

(52) U.S. Cl. ..... 271/121; 271/124

(58) Field of Classification Search ..... 271/124, 271/126, 127, 157, 121
See application file for complete search history.

(56) References Cited

U.S. PATENT DOCUMENTS 5,863,036 A * 1/1999 Tanaka et al. ..... 271/10.11
5,882,004 A * 3/1999 Padget ..... 271/119
5,984,297 A * 11/1999 Tanaka ..... 271/118
5,992,993 A 11/1999 Kiyohara et al.
6,000,689 A * 12/1999 Furuki et al. ..... 271/10.11
6,217,017 B1 * 4/2001 Yamazaki ..... 271/121
6,283,468 B1 * 9/2001 Sugiura ..... 271/119
6,550,759 B1 * 4/2003 Kotaka et al. ..... 271/10.11

FOREIGN PATENT DOCUMENTS

JP 4-189226 A 7/1992
JP 5-178483 * 7/1993
JP 8-40578 A 2/1996
JP 2001-19194 A 1/2001
JP 2001-72271 A 3/2001

* cited by examiner

*Primary Examiner*—Kathy Matecki
*Assistant Examiner*—Thomas Morrison
(74) *Attorney, Agent, or Firm*—Birch, Stewart, Kolasch, and Birch, LLP

(57) ABSTRACT

A plurality of sheets stacked on a lifting plate are fed to a separator plate and separated so that only a single sheet will be transported with the rotation of a feed roller. The single sheet is transported downstream in a sheet feeding direction. When the single sheet has been transported to a target position reaching a transport roller and a pinch roller, a sheet aligning/pressing portion and a separator plate pressing portion displace the remaining sheets in a direction away from the feed roller. This causes an abutting portion to move away from the feed roller, and prevent the remaining sheets from moving downstream in the sheet feeding direction.

6 Claims, 13 Drawing Sheets

SHEET FEEDING APPARATUS

BACKGROUND OF THE INVENTION

1. Field of the Invention

The present invention relates to a sheet feeding apparatus for feeding a sheet.

In the present invention, the term "sheet" includes a recording sheets made of paper or other material, and the term "substantially vertical" includes "vertical".

2. Description of the Related Art

FIG. 10 is a cross sectional view showing a first sheet feeding apparatus 1 according to related art. The first sheet feeding apparatus 1 of the related art includes a tray 3, a feed roller 4, a lifting plate 5, a separator plate 6, a spring 7, and a biasing spring 8. Sheets 2 are stacked on the lifting plate 5 in the tray 3. The feed roller 4 is disposed on the side of the stacked sheets 2 opposite from the side thereof supported on the lifting plate 5. The lifting plate 5 is mounted so as to be movable toward and away from the feed roller 4. The lifting plate 5 is biased toward the feed roller 4 by means of the spring 7, and holds the sheets 2 by cooperating with the feed roller 4. The separator plate 6 is disposed opposite the feed roller 4 on the downstream side of the tray 3 as viewed in a sheet feeding direction A1, and is biased by the biasing spring 8 into contact with the feed roller 4.

When the feed roller 4 is rotated, sheets 2 are fed to the position between the feed roller 4 and the separator plate 6 arranged downstream in the sheet feeding direction A1, and the sheets 2 are thus held between the feed roller 4 and the separator plate 6. Of the sheets 2 held between the feed roller 4 and the separator plate 6, only one sheet 2*a* closest to the feed roller 4 is separated by the separator plate 6, and transported to the position between a pinch roller 9 disposed downstream in the sheet feeding direction A1 and a transport roller 10 disclosed opposite the pinch roller 9. Of the sheets 2 held between the feed roller 4 and the separator plate 6, the remaining sheets, i.e., the sheets excluding the one sheet 2*a*, are not transported in the sheet feeding direction A1 but remain held between the feed roller 4 and the separator plate 6.

The one sheet 2*a* that has been transported by the feed roller 4 to the position between the pinch roller 9 and the transport roller 10 is further transported downstream in the sheet feeding direction A1 while being held between the pinch roller 9 and the transport roller 10 as well as between the feed roller 4 and the separator plate 6. After that, the upstream end of the one sheet 2*a*, as viewed in the sheet feeding direction A1, is gripped between the feed roller 4 and the separator plate 6. As the one sheet 2*a* is fed incrementally by a predetermined feed amount downstream in the sheet feeding direction A1 by means of the pinch roller 9 and the transport roller 10, an image is formed on the one sheet 2*a* by a print head 12 of a printer mechanism 11.

FIG. 11 is a cross sectional view showing second sheet feeding apparatus 15 according to the related art. In the second feeding apparatus 15, the construction except that of the feed roller 16 is the same as the construction of the first sheet feeding apparatus 1 of the related art, and corresponding parts are therefore designated by the same reference numerals. The feed roller 16 has a cut portion 16*b* formed by cutting one side flat, and a roller contacting portion 16*a* formed from the cylindrically faced remaining portion, i.e., the portion excluding the side cut portion 16*b*. The feed roller 16 is disposed on the side of the stacked sheets 2 opposite from the side thereof supported on the lifting plate 5.

When the feed roller 16 is rotated while holding the sheets 2 between the lifting plate 5 and the roller contacting portion 16*a* of the feed roller 16, some of the upper sheets 2 are fed to the position between the feed roller 16 and the separator plate 6 arranged downstream in the sheet feeding direction A1. Of the sheets 2 held between the feed roller 16 and the separator plate 6, only the one sheet 2*a* is separated by the separator plate 6, and transported to the position between the pinch roller 9 and the transport roller 10 arranged downstream in the sheet feeding direction A1. When the one sheet 2*a* is transported to the position between the pinch roller 9 and the transport roller 10, the cut portion 16*b*, instead of the roller contacting portion 16*a*, comes to face the one sheet 2*a*. As a result, the one sheet 2*a* is separated from the feed roller 16, and transported by means of the pinch roller 9 and the transport roller 10 by being held between the pinch roller 9 and the transport roller 10.

FIG. 12 is a cross sectional view showing a third sheet feeding apparatus 20 according to the related art. The third sheet feeding apparatus 20 of the related art includes a tray 22, a lifting plate 23, a feed roller 24, a spring 25, and an auxiliary roller 26. Sheets 21 are stacked on the lifting plate 23 in the tray 22. A limiting plate 22*a*, which is disposed integrally with the tray 22, is located downstream of the sheets 21 in the feeding direction A2, and comprises a portion whose cross section taken perpendicularly to a sheet feeding direction A2 is substantially L shaped, more specifically, a portion extending toward the feed roller 24 and a portion formed so as to extend from the downstream to the upstream side in the sheet feeding direction A2. The leading edges of the sheets 21 stacked on the lifting plate 23 abut the limiting plate 22*a*. The feed roller 24 is disposed on the side of the stacked sheets 21 opposite from the side thereof supported on the lifting plate 23. The lifting plate 23 is mounted so as to be movable toward and away from the feed roller 24. The lifting plate 23 is biased toward the feed roller 24 by means of the spring 25, and holds the sheets 21 by cooperating with the feed roller 24. The auxiliary roller 26 is disposed on the same side as the feed roller 24 with respect to the sheets 21 stacked on the lifting plate 23. The auxiliary roller 26 is mounted rotatably about the axis of rotation of the feed roller 24. Further, the auxiliary roller 26 is located nearer to the sheets 21 than the feed roller 24 is, and rotates about its axis of rotation extending parallel to the axis of rotation of the feed roller 24.

When the feed roller 24 is rotated while holding the sheets 21 between the feed roller 24 and the lifting plate 23, one sheet 21*a* closest to the feed roller 24 is fed out with its leading edge riding over the limiting plate 22*a*, and is thus advanced to a pair of transport rollers 27 disposed downstream in the sheet feeding direction A2. When the one sheet 21*a* is fed to the position between the pair of transport rollers 27, the feed roller 24 and the pair of transport rollers 27 rotate in such a manner as to feed the one sheet 21*a* in the direction opposite to the sheet feeding direction A2. With the feed roller 24 rotating in this manner, the auxiliary roller 26 presses the one sheet 21*a* and the remaining sheets 21 excluding the one sheet 21*a*, and the one sheet 21*a* is thus separated from the feed roller 24. With the one sheet 21*a* held between the lifting plate 23 and the auxiliary roller 26 as well as between the pair of transport rollers 27, the feed roller 24 and the pair of transport rollers 27 are rotated to transport the one sheet 21*a* downstream in the sheet feeding direction A2.

FIG. 13 is a cross sectional view showing a fourth sheet feeding apparatus 30 according to the related art. The sheet feeding apparatus 30 of the related art includes a lifting plate 32, a feed roller 33, a limiting plate 34, and a pair of transport rollers 35. Sheets 31 are stacked on the lifting plate 32. The lifting plate 32 is mounted so as to be movable toward and away from the feed roller 33, while the feed roller 33 is disposed on the side of the stacked sheets 31 opposite from the side thereof supported on the lifting plate 32. The lifting plate 32 is provided with a protruding portion 32*a* protruding toward the feed roller 33. The drive shaft 33*a* of the feed roller 33 is provided with an engaging portion 33*b* which rotates with the rotation of the feed roller 33 and engages with the protruding portion 32*a* of the lifting plate 32. The lifting plate 32 is biased toward the feed roller 33, and holds the sheets 31 by cooperating with the feed roller 33. The limiting plate 34 is a plate-like member which is formed perpendicularly to a sheet feeding direction A3 and fixed in position on the downstream side of the lifting plate 32 as viewed in the sheet feeding direction A3 . The leading edges of the sheets 31 stacked on the lifting plate 32 abut the limiting plate 34. The pair of transport rollers 35 are disposed on the downstream side of the limiting plate 34 as viewed in the sheet feeding direction A3.

When the feed roller 33 is rotated while holding the sheets 31 between the lifting plate 32 and the feed roller 33, one sheet 31*a* closest to the feed roller 33 is fed out with its leading edge riding over the limiting plate 34, and is thus advanced to the pair of transport rollers 35 disposed downstream in the sheet feeding direction A3. With the rotation of the feed roller 33, the engaging portion 33*b* rotates until it engages with the protruding portion 32*a* of the lifting plate 32. This releases the holding of the one sheet 31*a* by the feed roller 33 and the lifting plate 32, and the one sheet 31*a* is transported downstream in the sheet feeding direction A3 by the pair of transport rollers 35 alone.

FIG. 14 is a cross sectional view showing a fifth sheet feeding apparatus 40 according to the related art. The fifth sheet feeding apparatus 40 of the related art includes a limiting plate 44, a lifting plate 42, a feed roller 43, a spring 45, a separator plate 46, a biasing spring 47, and an actuator arm 48. The lifting plate 42 is mounted so as to be movable toward and away from the feed roller 43, and sheets 41 are stacked on the lifting plate 42. The feed roller 43 is disposed on the side of the stacked sheets 41 opposite from the side thereof supported on the lifting plate 42. The lifting plate 42 is held engaged in such a position as to keep the sheets 41 separated from the feed roller 43 as shown by solid lines in FIG. 14 until the feed operation of the sheets 41 is started; when starting the feed operation of the sheets 41, the lifting plate 42 is disengaged, and holds the sheets 41 by the biasing force of the spring 45 by cooperating with the feed roller 43 as shown by imaginary lines in FIG. 14. The limiting plate 44 is a plate-like member which is disposed with its one end spaced apart from the feed roller. The limiting plate 44 is formed perpendicularly to a sheet feeding direction A4, and is disposed on the downstream side of the lifting plate 42 as viewed in the sheet feeding direction A4. The separator plate 46 is disposed opposite the feed roller 43 on the downstream side of the limiting plate 44 as viewed in the sheet feeding direction A4. The downstream end of the separator plate 46, as viewed in the sheet feeding direction A4, is supported so as to be angularly movable about an axis extending perpendicularly to the sheet feeding direction A4; the separator plate 46 is brought into contact with the feed roller 43 by being biased toward the feed roller 43 by means of the biasing spring 47. The actuator arm 48 is disposed on the upstream side of the separator plate 46 as viewed in the sheet feeding direction A4, and mounted so as to be angularly movable about an axis extending parallel to the width direction of the transport path along which the sheet is transported. The actuator arm 48 presses the separator plate 46 to separate it from the feed roller 43.

When the lifting plate 42 is disengaged as described above, the stacked sheets 41 are displaced in a direction toward the feed roller 43 by the biasing force of the spring 45. Before the sheets 41 are sandwiched between the lifting plate 42 and the feed roller 43, a plurality of sheets 41 including one sheet 41*a* closest to the feed roller 43 are allowed to run over the limiting plate 44 in the downstream direction along the sheet feeding direction A4. When the feed roller 43 is rotated after the sheets have been held between the lifting plate 42 and the feed roller 43, the one sheet 41*a* is separated by the separator plate 46 from the remaining sheets 41 excluding the one sheet 41*a*, and the one sheet 41*a* is transported downstream in the sheet feeding direction A4. When the one sheet 41*a* is separated by the separator means 46, the lifting plate 42 is moved in a direction away from the feed roller 43, thus releasing the holding of the sheets 41 by the feed roller 43 and the lifting plate 42. Thereafter, when the one sheet 41*a* is detected reaching the position between a pair of transport rollers disposed downstream in the sheet feeding direction A4, the separator plate 46 is separated from the feed roller 43 by the action of the actuator arm 48 and, in this condition, the one sheet 41*a* is transported downstream in the sheet feeding direction A4.

FIG. 15 is a cross sectional view showing a sixth sheet feeding apparatus 50 according to the related art. The sixth sheet feeding apparatus 50 of the related art includes a lifting plate 52, a feed roller 53, an idle roller 54, a separator plate 55, and a push-back means 56. Sheets 51 are stacked on the lifting plate 52. The lifting plate 52 is mounted so as to be movable toward and away from the feed roller 53. The feed roller 53 is disposed on the side of the stacked sheets 51 opposite from the side thereof supported on the lifting plate 52, and holds the sheet 51*a* by cooperating with the lifting plate 52. The idle roller 54 is mounted so as to be movable about an axis extending parallel to the width direction of the transport path along which the sheet is transported, and is disposed spaced apart in the width direction from the feed roller 53. The idle roller 54 is disposed in contacting relationship with the separator plate 55. The separator plate 55 is disposed opposite the feed roller 53 and the idle roller 54 on the downstream side of the lifting plate 52 as viewed in a sheet feeding direction A5. When the lifting plate 52 is moved toward the feed roller 53, the pushing of the separator plate 55 by the lifting plate 52 is released and moves toward the feed roller 53; when the lifting plate 52 is moved in a direction away from the feed roller 53, the separator plate 55 is separated from the feed roller 53 by being pressed by the lifting plate 52. The push-back means 56 is disposed downstream of the lifting plate 52 in the sheet feeding direction A5, and works to hold back the remaining sheets 51, excluding the one sheet 51*a* closest to the feed roller 53, toward the upstream side of the sheet feeding direction A5 after the one sheet 51*a* has been separated from the remaining sheets 51 by the separator plate 55.

When the feed roller 53 is rotated while holding the sheets 51 between the lifting plate 52 and the feed roller 53, the sheets 51 are fed to the position between the feed roller 53 and the separator plate 55 and between the idle roller 54 and the separator plate 55. The one sheet 51*a* is separated from the remaining sheet 51 by the separator plate 55 and transported to the position between a pair of transport rollers disposed downstream in the sheet feeding direction A5. When the one sheet 51*a* is fed to the position between the pair of transport rollers, the lifting plate 52 is moved in a direction away from the feed roller 53 and presses the separator plate 55. This causes the separator plate 55 with the idle roller 54 contacting thereon to move away from the feed roller 53, thereby releasing the holding of the sheets 51 by the separator plate 55 and the feed roller 53. The one sheet 51*a*, while being held between the pair of transport rollers as well as between the idle roller 54 and the separator plate 55, is transported downstream in the sheet feeding direction A5. The remaining sheets 51 are not transported downstream in the sheet feeding direction A5, but remain held between the idle roller 54 and the separator plate 55. When the one sheet 51*a* is transported downstream in the sheet feeding direction A5 by the pair of transport rollers, and is fed out of the machine after an image is formed on the one sheet 51*a*, the remaining sheets 51 are pushed back by the push-back means 56 toward the upstream side of the sheet feeding direction A5.

In the first sheet feeding apparatus 1 of the related art, when the one sheet 2*a* is transported by the pinch roller 9 and the transport roller 10, the one sheet 2*a* is held between the feed roller 4 and the separator plate 6 as well as between the pinch roller 9 and the transport roller 10. When the one sheet 2*a* is kept held between the feed roller 4 and the separator plate 6 as well as between the pinch roller 9 and the transport roller 10, back tension acting in the direction opposite to the sheet feeding direction A1 is exerted on the one sheet 2*a* since the upstream end thereof as viewed in the sheet feeding direction A1 is held between the feed roller 4 and the separator plate 6. This back tension is an unstable force that changes as the one sheet 2*a* is transported downstream in the sheet feeding direction A1. In particular, when the holding of one sheet 2*a* by the feed roller 4 and the separator plate 6 is released, the back tension being exerted on the one sheet 2*a* changes abruptly. This can cause a variation in the feed amount by which the one sheet 2*a* is fed downstream in the sheet feeding direction A1, resulting in skewed feeding with respect to the sheet feeding direction A1. Therefore, a high quality image cannot be formed on the sheet 2.

In the second sheet feeding apparatus 15 of the related art, the occurrence of back tension can be prevented by forming the cut portion 16*b* on the feed roller 16, but the remaining sheets are separated from the feed roller 16 and the holding of the remaining sheets by the feed roller 16 and the separator plate 6 is released. As a result, the remaining sheets slide downward in the downstream direction along the sheet feeding direction A1, and this can cause a double feed, a phenomenon in which more than one sheet 2 is fed out simultaneously downstream in the sheet feeding direction A1, when performing sheet feeding by using the remaining sheets.

In the third sheet feeding apparatus 20 of the related art, since the one sheet 21*a* is fed downstream in the sheet feeding direction A2 while being held between the auxiliary roller 26 and the lifting plate 23 as well as between the pair of transport rollers 27, there occurs a problem similar to that encountered in the first sheet feeding apparatus 1 of the related art. While the apparatus is constructed so that the sheets 21 stacked on the lifting plate 23 are fed downstream in the sheet feeding direction A2 by separating one sheet 21 at a time by the feed roller 26 and the lifting plate 23, simultaneous feeding of a plurality of sheets 21, that is, double feeding, may occur depending on the number of sheets 21. Furthermore, with the presence of the limiting plate 22*a*, the sheet 21 may be deflected along the limiting plate 22*a*, restraining the feeding of the sheet 21 toward the downstream side in the sheet feeding direction A2, and this can result in a misfeed condition in which the sheet 21 is not fed out.

In the fourth sheet feeding apparatus of the related art, since the limiting plate 34, a plate-like member, is fixedly provided on the downstream side of the lifting plate 32 as viewed in the sheet feeding direction A3, the feeding of the sheet 31 in the downstream direction along the sheet feeding direction A3 may be restrained, resulting in a misfeed condition in which the sheet 31 is not fed out. Furthermore, the apparatus is constructed so that the sheets 31 stacked on the lifting plate 32 are fed downstream in the sheet feeding direction A3 by separating one sheet 31 at a time by the feed roller 33 and the lifting plate 32 but, when the plurality of sheets 31 are fed downstream in the sheet feeding direction A3 by the feed roller 33, the sheets may not be able to be separated by the limiting plate 34, resulting in a double feed, a phenomenon in which more than one sheet 31 is fed out simultaneously.

In the fifth sheet feeding apparatus 40 of the related art, when transporting the one sheet 41*a* by the pair of transport rollers, the holding of the one sheet 41*a* by the feed roller 43 and the separator plate 46 is released, and the remaining sheets are not held between the feed roller 43 and the separator plate 46; this can also result in a double feed condition in which more than one remaining sheet is fed out simultaneously by the feed roller 43 in the downstream direction along the sheet feeding direction A4.

In the sixth sheet feeding apparatus 50 of the related art, since the one sheet 51*a* is transported downstream in the sheet feeding direction A while being held between the idle roller 54 and the lifting plate 52 as well as between the pair of transport rollers, back tension occurs, and this can cause a problem similar to that encountered in the first sheet feeding apparatus 1 of the related art.

In the sheet feeding apparatuses 1, 15, 20, 30, 40, and 50 of the related art, since trouble occurs when feeding sheets, or more specifically, when feeding one sheet, as described above, the sheet cannot be fed accurately and stably. Furthermore, in the related art, there is disclosed no apparatus that can simultaneously achieve the separation of the remaining sheets, excluding the one sheet, from the feed roller, the separation of the separator plate from the feed roller, and the restraining of the movement of the remaining sheets in the downstream direction along the sheet feeding direction, after the one sheet closest to the feed roller has been separated by the separator plate.

SUMMARY OF THE INVENTION

An object of the invention is to provide a sheet feeding apparatus that can feed a sheet accurately and stably by eliminating sheet feeding problems such as double feeding and misfeeding.

The invention provides a sheet feeding apparatus comprising:

rotatable feeding means for feeding a sheet by rotation thereof;

supporting means, having a supporting portion movable toward and away from the rotatable feeding means, for supporting a plurality of stacked sheets from a side opposite from the rotatable feeding means, and for elastically causing one sheet closest to the rotatable feeding means to contact the rotatable feeding means;

separating means, having an abutting portion movable toward and away from the rotatable feeding means, for elastically holding the sheets between the abutting portion and the rotatable feeding means, and for separating the sheets so as to allow only the one sheet closest to the rotatable feeding means to be fed out with the rotation of the rotatable feeding means, the separating means being disposed downstream of the supporting means in a sheet feeding direction;

sheet separating means for displacing remaining sheets in a direction away from the rotatable feeding means when the one sheet has been advanced to a target position reaching sheet transporting means disposed downstream in the sheet feeding direction;

abutting portion separating means for moving the abutting portion in a direction away from the rotatable feeding means so as to release the holding of the sheets between the abutting portion and the abutting portion and the rotatable feeding means when the one sheet has reached the target position; and limiting means for preventing the remaining sheets, excluding the one sheet, from moving downstream in the sheet feeding direction when the one sheet has reached the target position.

According to the invention, the supporting portion of the supporting means is mounted so as to be movable toward and away from the rotatable feeding means, and the plurality of sheets are stacked on the supporting means. The separating means is disposed downstream of the supporting means in the sheet feeding direction, and the abutting portion of the separating means is disposed so as to be movable toward and away from the rotatable feeding means. By supporting the plurality of stacked sheets by the supporting means from the side opposite from the rotatable feeding means, one sheet closest to the rotatable feeding means can be elastically pressed against the rotatable feeding means. When the rotatable feeding means is rotated while elastically pressing the one sheet against the rotatable feeding means, sheets are fed downstream in the sheet feeding direction and elastically held between the abutting portion of the separating means and the rotatable feeding means. The sheets are separated by the separating means so that, of the sheets elastically held between the abutting portion and the rotatable feeding means, only the one sheet closest to the rotatable feeding means will be fed out with the rotation of the rotatable feeding means.

When the one sheet has been advanced to the target position reaching the sheet transporting means disposed downstream in the sheet feeding direction, the sheet separating means displaces the remaining sheets in a direction away from the rotatable feeding means and thus separates the remaining sheets from the rotatable feeding means. When the one sheet has been advanced to the target position, the abutting portion separating means moves the abutting portion in a direction away from the rotatable feeding means, thus releasing the holding of the sheets between the abutting portion and the rotatable feeding means. When the one sheet has been advanced to the target position, the remaining sheets excluding the one sheet are prevented by the limiting means from moving downstream in the sheet feeding direction. As described above, when the one sheet has been advanced to the target position, the holding of the sheets, including the one sheet, by the abutting portion and the rotatable feeding means is released; since the one sheet is no longer held between the abutting portion and the rotatable feeding means, the one sheet can be transported with its leading edge held by the transporting means. This prevents the one sheet from being subjected to the pulling force that would be exerted in opposition to the sheet feeding direction if the one sheet remained held between the abutting portion and the rotatable feeding means. Further, even when the remaining sheets have been displaced in a direction away from the rotatable feeding means by the sheet separating means, since the limiting means prevents the remaining sheets from moving downstream in the sheet feeding direction, the remaining sheets can be prevented from being fed out together with the one sheet.

Accordingly, the accuracy of the sheet feeding operation can be improved, that is, the sheets can be reliably fed one sheet at a time, for example, by preventing more than one sheet from being transported simultaneously to the transporting means. Furthermore, the stability of the sheet feeding operation can be improved, that is, the sheets can be stably fed, for example, by eliminating such problems as the inability to form a high quality image because of the sheet being fed skewed with respect to the sheet feeding direction and the inability to feed the sheet downstream in the sheet feeding direction because of the sheet getting jammed along the path.

In the invention it is preferable that the sheet separating means is provided adjacent to the rotatable feeding means, and displaces the sheets near the rotatable feeding means by pressing the sheets from a side adjacent to the rotatable feeding means.

According to the invention, the sheet separating means is provided adjacent to the rotatable feeding means, and the sheets are displaced near the rotatable feeding means by being pressed from the side adjacent to the rotatable feeding means. In this way, the remaining sheets, excluding the one sheet closest to the rotatable feeding means, can be reliably displaced in a direction away from the rotatable feeding means and separated from the rotatable feeding means, regardless of the number of remaining sheets.

In the invention it is preferable that the limiting means aligns leading edges of leftover sheets which are the sheets fed to the separating means from the remaining sheets by the rotatable feeding means and separated from the one sheet by the separating means.

According to the invention, of the remaining sheets, the leftover sheets and the sheets fed to the separating means by the rotatable feeding means and separated from the one sheet by the separating means. The leading edges of the leftover sheets are aligned by the limiting means. By releasing the holding of the leftover sheets by the abutting portion of the separating means and the rotatable feeding means, the leftover sheets are loosened, and the leading edges of the leftover sheets can thus be aligned securely by the limiting means even when the leading edges of the leftover sheets are skewed with respect to the sheet feeding direction. Accordingly, the leftover sheets can be set ready for feeding to the transporting means, and the stability of the sheet feed operation can thus be improved.

In the invention it is preferable that:

the sheet separating means and the limiting means are integrally disposed;

the sheet separating means pushes back leftover sheets upstream of the separating means in the sheet feeding direction; and the limiting means aligns and supports the leading edges of the leftover sheets pushed back by the sheet separating means.

According to the invention, the sheet separating means and the limiting means are integrally disposed. The leftover sheets are pushed back by the sheet separating means toward the upstream side of the separating means in the sheet feeding direction, and the leading edges of the leftover sheets pushed back by the sheet separating means are aligned and supported by the limiting means. Since the sheet separating means and the limiting means are integrally disposed, the leading edges of the leftover sheets can be securely aligned after the leftover sheets have been pushed back toward the upstream side of the sheet feeding direction. As a result, when performing sheet feeding by using the leftover sheets, the leftover sheets can be held between the abutting portion and the rotatable feeding means with their leading edges aligned properly.

In the invention it is preferable that the sheet feeding apparatus further comprises:

a common drive shaft member rotatably supported, for driving in common the sheet separating means, the abutting portion separating means, and the limiting means which are connected in common;

a rotational driving source; and transmitting means for transmitting a drive force from the rotational driving source to the common drive shaft member, the transmitting means having a partially toothed gear with teeth formed only on a portion of a circumference thereof.

According to the invention, the common drive shaft member is rotatably supported, to which the sheet separating means, the abutting portion separating means, and the limiting means are connected in common, and the sheet separating means, the abutting portion separating means, and the limiting means are driven in common by the common drive shaft member. The drive force from the rotational driving source is transmitted to the common drive shaft member by the transmitting means. When the drive force from the rotational driving source is transmitted to the common drive shaft member by the transmitting means, the common drive shaft member is driven to rotate, causing the sheet separating means, the abutting portion separating means, and the limiting means to rotate. The transmitting means has a partially toothed gear with teeth formed only on a portion of its circumference, and by using this partially toothed gear, the condition in which the drive force from the rotational driving source is transmitted to the common drive shaft member and the condition in which the drive force is not transmitted to the common drive shaft member can be created. With this arrangement, only the drive amount determined by the partially toothed gear can be transmitted to the common drive shaft member by preventing the sheet separating means, the abutting portion separating means, and the limiting means from being driven to rotate by the common drive shaft member beyond the predetermined drive amount.

In the invention it is preferable that the sheet feeding apparatus further comprises:

a feed shaft member rotatably supported, the rotatable feeding means being connected thereto;

a common drive shaft member rotatably supported, for driving in common the sheet separating means, the abutting portion separating means, and the limiting means which are connected thereto in common;

a rotational driving source; and transmitting means for transmitting a drive force from the rotational driving source to the feed shaft member and the common drive shaft member, the transmitting means having a sun gear which rotates in an interlocking fashion with an output shaft of the rotational driving source, a feed input gear which is mounted in an area surrounding the sun gear and rotates in an interlocking fashion with the feed shaft member, a common input gear which is mounted in the area surrounding the sun gear and in a position circumferentially spaced apart from the feed input gear and rotates in an interlocking fashion with the common drive shaft member, and a planet gear which is in meshing engagement with the sun gear, and the planet gear being mounted so as to be movable around the sun gear between a feed input position, where rotational force is transmitted to the feed input gear, and a common input position, where rotational force is transmitted to the common input gear.

According to the invention, the feed shaft member and the common drive shaft member are each supported rotatably. The rotatable feeding means is connected to the feed shaft member, while the sheet separating means, the abutting portion separating means, and the limiting means are connected in common to the common drive shaft member. The sheet separating means, the abutting portion separating means, and the limiting means are driven in common by the common drive shaft member. The drive force from the rotational driving source is transmitted by the transmitting means to the feed shaft member and the common drive shaft member. When the drive force from the rotational driving source is transmitted by the transmitting means to the feed shaft member and the common drive shaft member, the feed shaft member is driven to rotate, causing the rotatable feeding means to rotate, and the common drive shaft member is driven to rotate, causing the sheet separating means, the abutting portion separating means, and the limiting means to rotate in synchronized fashion.

The transmitting means includes the sun gear, the feed input gear, the common input gear, and the planet gear. The sun gear is mounted so as to rotate in an interlocking fashion with the output shaft of the rotational driving source, the feed input gear is mounted in an area surrounding the sun gear and rotates in an interlocking fashion with the feed shaft member, and the common input gear is mounted in a position circumferentially spaced apart from the feed input gear in the area surrounding the sun gear, and rotates in an interlocking fashion with the common drive shaft member. The planet gear is mounted in meshing engagement with the sun gear in such a manner as to be movable around the sun gear between the feed input position, where the rotational force is transmitted to the feed input gear, and the common input position, where the rotational force is transmitted to the common input gear.

When the output shaft of the rotational driving source rotates, the sun gear rotates in an interlocking fashion with the output shaft, causing the planet gear engaged with the sun gear to move around the sun gear into either the feed input position or the common input position. When the planet gear is moved to the feed input position, the planet gear transmits the rotational force to the feed input gear and causes the feed input gear to rotate; the drive force from the rotational driving source can thus be transmitted to the feed shaft member. The rotatable feeding means can be driven in this way. When the planet gear is moved to the common input position, the planet gear transmits the rotational force to the common input gear and causes the common input gear to rotate; the drive force from the rotational driving source can thus be transmitted to the common drive shaft member. In this way, the sheet separating means, the abutting portion separating means, and the limiting means can be driven in synchronized fashion. By moving the planet gear either to the feed input position or the common input position as described above, either the rotatable feeding means or the sheet separating means, the abutting portion separating means, and the limiting means can be selected for driving. Since either the rotatable feeding means or the sheet separating means, the abutting portion separating means, and the limiting means, whichever selected, can be reliably operated in this manner, the accuracy and stability of the sheet feeding operation of the sheet feeding apparatus can be improved.

Furthermore, since the transmitting means is constructed by simply combining various gears, the size of the sheet feeding apparatus can be reduced, and the reliability of the sheet feeding operation of the sheet feeding apparatus can be improved.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
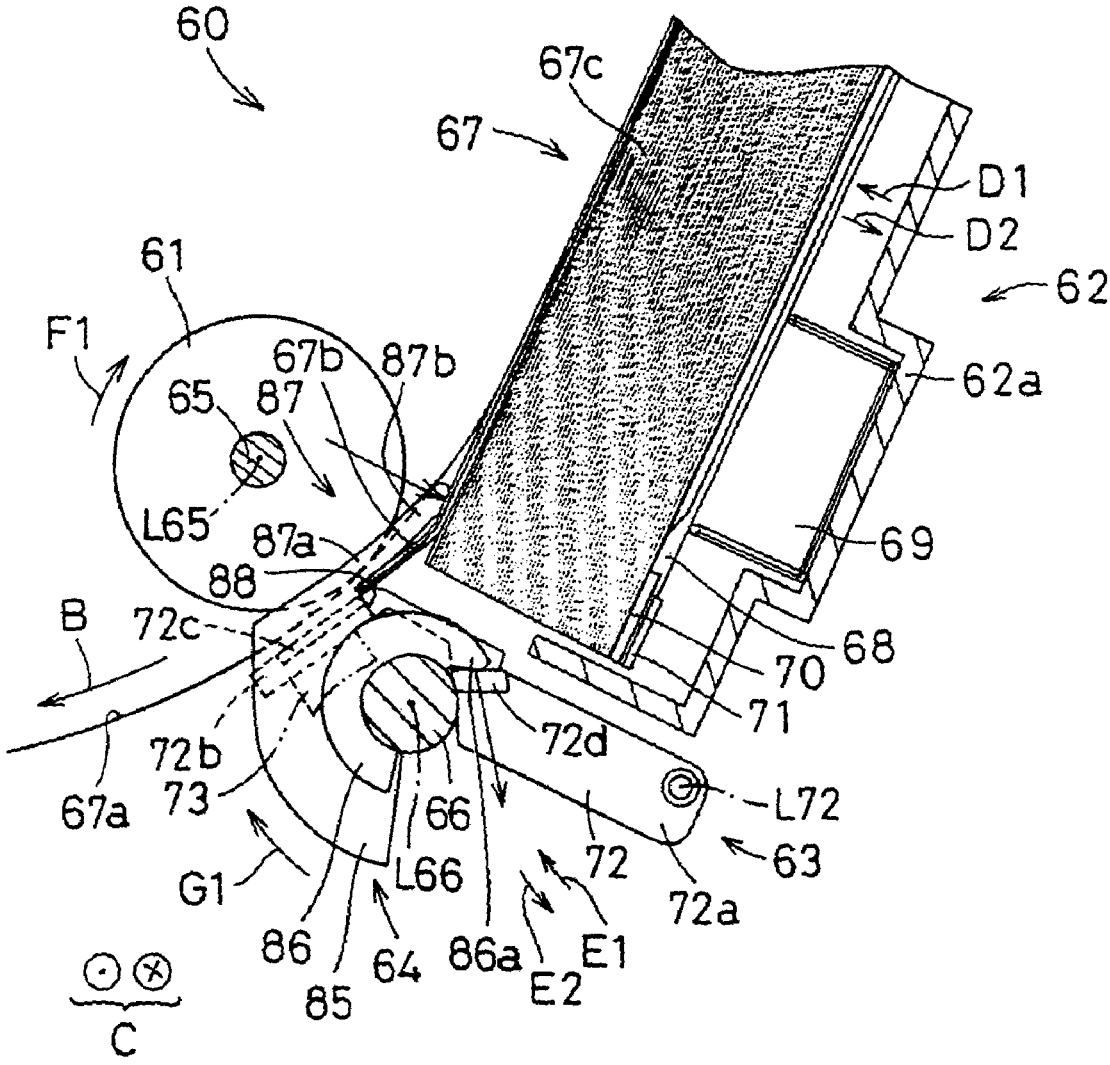
FIG. 1 is a cross sectional view showing a sheet feeding apparatus according to one embodiment of the invention.

Now referring to the drawings, preferred embodiments of the invention are described below.

Figure 2:
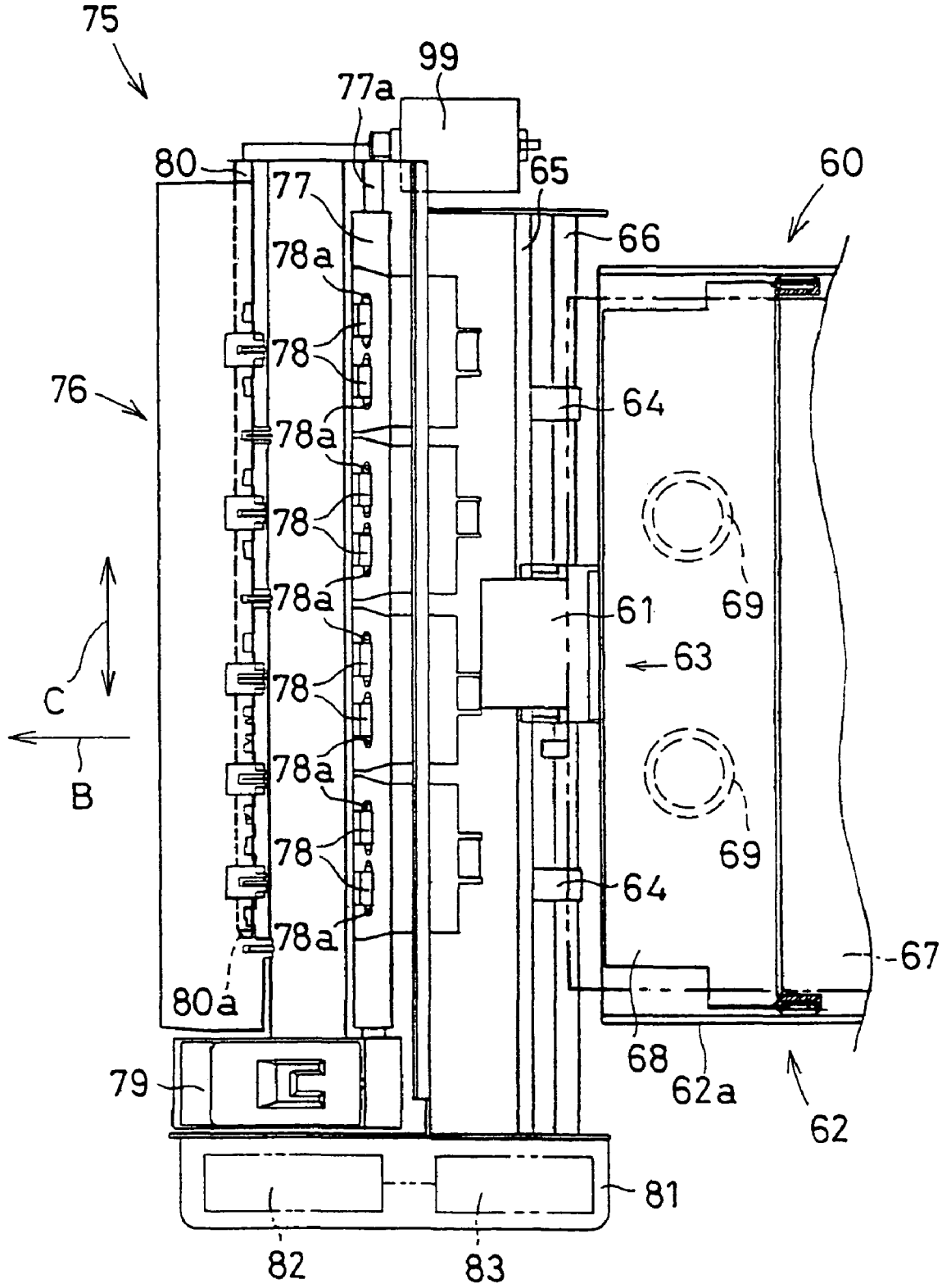
FIG. 2 is a plan view showing the sheet feeding apparatus and a printer section.
Figure 3:
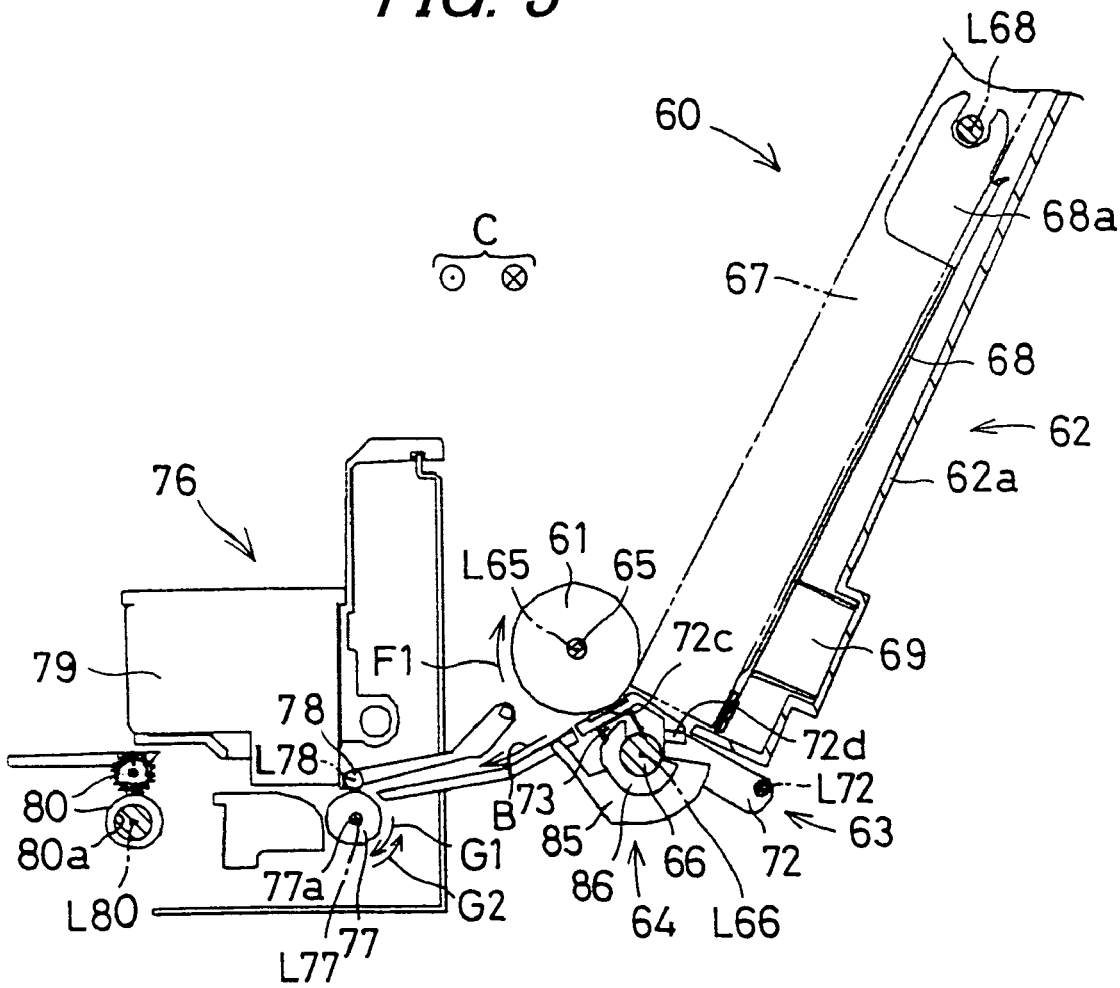
FIG. 3 is a cross sectional view showing the sheet feeding apparatus and the printer section.

FIG. 1 is a cross sectional view showing a sheet feeding apparatus 60 according to one embodiment of the present invention. FIG. 2 is a plan view showing the sheet feeding apparatus 60 and a printer section 76. FIG. 3 is a cross sectional view showing the sheet feeding apparatus 60 and the printer section 76. The sheet feeding apparatus 60 comprises a feed roller 61, a tray 62, a separating means 63, an aligning/pressing means 64, a feed shaft member 65, and a common drive shaft member 66. The sheet feeding apparatus 60 is an apparatus for feeding a plurality of sheets 67, stacked on a lifting plate 68 to be described later, one sheet at a time to the printer section 76 (see FIGS. 2 and 3) connected downstream thereof in a sheet feeding direction B. The sheet feeding direction B is a direction that coincides with the extending direction of a transport path along which the sheet 67 is transported.

The feed roller 61 is a rotatable feeding means which is mounted rotatably about a predetermined axis and is rotated to feed the sheet 67 downstream in the sheet feeding direction B. The feed roller 61 is connected to the feed shaft member 65 that is supported rotatably about an axis L65 extending parallel to the width direction C of the transport path along which the sheet 67 is transported. The feed roller 61 is driven for rotation by the feed shaft member 65 rotating about its axis L65.

The tray 62 is disposed opposite the feed roller 61, and includes the lifting plate 68 and a first biasing spring 69. The lifting plate 68 is a supporting member movable in directions toward and away from the feed roller 61, and one end portion 68*a* thereof located upstream as viewed in the sheet feeding direction B is mounted on a frame 62*a* of the tray 62 in such a manner as to be rotatable about an axis L68 extending parallel to the width direction C.

At the other end portion 68*a* of the lifting plate 68 downstream in the sheet feeding direction B, a member 70 having a suitable friction coefficient, such as a rubber, is provided facing the sheets 67 in order to prevent the stacked sheets 67 from slipping downward in the downstream direction along the sheet feeding direction B. At the other end portion 68*a* of the lifting plate 68 is also provided a cushion member 71, such as a rubber, disposed facing the frame 62*a* of the tray 62; this cushion member 71 acts to absorb and reduce a shock applied to the lifting member 68 and thereby to prevent the stacked sheets 67 from slipping downward in the downstream direction along the sheet feeding direction B because of the shock that may be caused when the lifting plate 68 is moved in a supporting member separating direction D2 and hits the frame 62*a* of the tray 62. The supporting member separating direction D2 is the direction in which the lifting member 68 is moved away from the feed roller 61.

The first biasing spring 69 is an elastic spring member which is mounted between the lifting plate 68 and the frame 62*a* of the tray 62 on the side of the lifting plate 68 opposite from the stacked sheets 67, and which biases the lifting plate 68 in a supporting member biasing direction D1. The supporting member biasing direction D1 is the direction in which the lifting member 68 is moved toward the feed roller 61. The tray 62 supports the plurality of sheets 67, stacked on the lifting plate 68, from the side opposite from the feed roller 61, and elastically causes one sheet 67*a* closest to the feed roller 61 to contact the feed roller 61. In the present embodiment, two such first bias springs 69 are arranged spaced apart from each other in the width direction C, as shown by dashed lines in FIG. 2.

The separating means 63 is disposed on the downstream side of the tray 62 in the feeding direction B of the sheets 67 in such a manner as to face the feed roller 61. The separating means 63 comprises a separator plate 72 and a second biasing spring 73. The separator plate 72 is substantially L-shaped plate which is mounted rotatably about a predetermined axis. More specifically, one end 72*a* of the separator plate 72 is connected to a shaft member (not shown) which is supported rotatably about an axis L72 extending parallel to the width direction C, and the other end 72*b* is moved in a separator plate biasing direction E1 or a separator plate separating direction E2 with the rotation of the shaft member about the axis L72.

The separator plate biasing direction E1 is the direction in which the separator plate 72, or more specifically, an abutting portion 72*c*, is moved toward the feed roller 61, while the separator plate separating direction E2 is the direction in which the separator plate 72, or more specifically, the abutting portion 72*c*, is moved away from the feed roller 61. The abutting portion 72*c* movable toward and away from the feed roller 61 is provided at the other end 72*b* of the separator plate 72. The abutting portion 72*c* is provided with a member having a suitable friction coefficient, such as a rubber, for separating a sheet. A protruding piece 72*d* protruding in the width direction C is provided at a position intermediate between the one end 72*a* and the other end 72*b* of the separator plate 72 and in close proximity to the common drive shaft member 66 to be described later.

The second biasing spring 73 is an elastic spring member which is mounted on the opposite side of the separator plate 72 from the side thereof facing the feed roller 61 and biases the separator plate 72 in the separator plate biasing direction E1 to bring the abutting portion 72*c* into contact with the feed roller 61. The separating means 63 elastically holds the sheets 67 between the feed roller 61 and the abutting portion 72*c*, and separates the sheets 67 so that only one sheet 67*a* closest to the feed roller 61 will be fed downstream in the sheet feeding direction B with the rotation of the feed roller 61.

The aligning/pressing means 64 is mounted rotatably about a predetermined axis, and connected to the common drive shaft member 66 which is supported rotatably about an axis L66 extending parallel to the width direction C. The aligning/pressing means 64 is driven for rotation by the common drive shaft member 66 rotating about its axis L66.

The sheet feeding apparatus 60 is provided, for example, as shown in FIGS. 2 and 3, in an image forming apparatus 75 which reads an image formed on a document and forms the image on a sheet fed therein. The image forming apparatus 75 further comprises the printer section 76 which is located downstream of the sheet feeding apparatus 60 in the sheet feeding direction B. The printer section 76 is a means for forming an image on the sheet 67.

When the feed roller 61 is rotated in a first feed rotation direction F1 while holding between the feed roller 61 and the lifting plate 68 the plurality of sheets 67 stacked on the lifting plate 68, some of the sheets 67 are advanced to the separating means 63 and held between the feed roller 61 and the abutting portion 72*c*. The first feed rotation direction F1 is the direction in which the feed shaft member 65 rotates so as to cause the feed roller 61 to feed the sheets 67 downstream in the sheet feeding direction B.

The separating means 63 separates the sheets 67 so that only one sheet 67*a* closest to the feed roller 61 will be fed out with the rotation of the feed roller 61. The leftover sheets 67*b* fed to the separating means 63 by the feed roller 61, and separated from the one sheet 67*a* by the separating means 63, are not transported downstream in the sheet feeding direction B together with the one sheet 67*a*, but remain held between the feed roller 61 and the abutting portion 72*c*.

With the rotation of the feed roller 61, the one sheet 67*a* is transported toward a transport roller 77 and a pinch roller 78 located downstream of the feed roller 61 in the sheet feeding direction B. The transport roller 77 and the pinch roller 78 together constitute a transporting means for transporting the sheet 67.

The transport roller 77 is connected to a transport shaft member 77*a* supported rotatably about an axis L77 extending parallel to the width direction C, and is driven for rotation by the transport shaft member 77*a* rotating about the axis L77. The pinch roller 78 is a driven roller which is connected to a pinch shaft member 78*a* supported rotatably about an axis L78 extending parallel to the width direction C, and which rotates about the axis L78 with the rotation of the transport roller 77. In the present embodiment, a plurality of such pinch rollers 78 are arranged spaced apart along the width direction C. The transport roller 77 and the pinch roller 78 are mounted in contacting relationship with each other.

The feed roller 61 is driven so that it rotates by an amount larger than the feed amount of the one sheet 67*a* that is required to advance the one sheet 67*a* to the target position, and the transport roller 77 is driven to rotate in a first transport rotation direction G1. The first transport rotation direction G1 is the direction in which the transport shaft member 77*a* rotates so that the transport roller 77 will not transport the one sheet 67*a* downstream in the sheet feeding direction B. The target position is, more specifically, the position where the transport roller 77 and the pinch roller 78 contact each other. A detecting means such as an optical sensor, for example, is used to detect whether the sheet 67 has reached the target position.

With the feed roller 61 and the transport roller 77 driven for rotation in the respective directions as described above, the one sheet 67*a* is not transported downstream in the sheet feeding direction B by the transport roller 77 and the pinch roller 78, but after the one sheet 67*a* has reached the target position, the one sheet 67*a* is transported downstream in the sheet feeding direction B by the rotation of the feed roller 61. This ensures that the leading edge of the one sheet 67*a* is aligned parallel with respect to the printer section 76; more specifically, since the main scanning direction in image formation is aligned parallel to the width direction C, the one sheet 67*a* can be prevented from becoming skewed with respect to the sheet feeding direction B.

When the one sheet 67*a* has been advanced to the target position, the aligning/pressing means 64 is rotated in a first aligning/pressing rotation direction H1. As a result, the remaining sheets 67*c* are displaced in a direction away from the feed roller 61, and the abutting portion 72*c* is moved away from the feed roller 61 to release the holding of the sheets 67 by the feed roller 61 and the abutting portion 72*c*; at the same time, the movement of the remaining sheets 67*c* in the downstream direction along the sheet feeding direction B is retrained. The first aligning/pressing rotation direction H1 is the direction in which the common drive shaft member 66 rotates so as to cause the aligning/pressing means 64 to perform the above action. The remaining sheets 67*c* refer to the plurality of sheets 67 stacked on the lifting plate 68, excluding the one sheet 67*a* but including the leftover sheets 67*b*.

With the remaining sheets 67*c* and the abutting portion 72*c* thus moved by the aligning/pressing means 64 away from the feed roller 61 while restraining the movement of the remaining sheets 67*c* in the downstream direction along the sheet feeding direction B, as described above, the one sheet 67*a* is transported downstream in the sheet feeding direction B by the transport roller 77 and the pinch roller 78.

The transport roller 77 is driven to rotate incrementally by a predetermined amount in a second transport rotation direction G2 opposite to the first transport rotation direction G1. The one sheet 67*a* is thus transported downstream in the sheet feeding direction B by the transport roller 77. By driving the transport roller 77 for rotation in this way, an image is formed on the one sheet 67*a* by means of a cartridge 79. The cartridge 79 is disposed downstream of the transport roller 77 and pinch roller 78 in the sheet feeding direction B, and includes a print head for forming an image such as characters and symbols.

The cartridge 79 is mounted so as to be movable in reciprocating fashion along the main scanning direction parallel to the width direction C. Each time the transport roller 77 is driven for rotation by the predetermined amount to feed the one sheet downstream in the sheet feeding direction B, the cartridge 79 is moved in reciprocating fashion along the main scanning direction for image formation. With the transport roller 77 and the cartridge 79 repeating the above action, an image is formed on the entire surface of the one sheet 67*a*.

When the image formation on the one sheet 67*a* is completed, the one sheet 67*a* is fed out of the machine by a pair of exit rollers 80 which are rotatably mounted along the width direction C and disposed downstream of the transport roller 77 and pinch roller 78 in the sheet feeding direction B. One of the pair of exit rollers 80 is connected to an exit shaft member 80*a* supported rotatably about an axis L80 extending parallel to the width direction C, and is driven for rotation by the rotation of the exit shaft member 80*a*, while the other roller rotates with the rotation of the one roller.

The sheet feeding apparatus 60 further comprises a drive force transmission mechanism 81 which generates drive force and transmits the drive force to the shaft members. The drive force transmission mechanism 81 comprises a rotational driving source 82 and a transmitting means 83. The rotational driving source 82 generates the drive force. The transmitting means 83 transmits the drive force to the feed shaft member 65 of the feed roller 61, the common drive shaft member 66 of the aligning/pressing means 64, and the shaft member of the transport roller 77.

In the present embodiment, the exit shaft member 80*a* of the exit roller 80 is driven by the drive force transmitted from another drive source 99 provided in the sheet feeding apparatus 60 separately from the rotational driving source 82. The feed roller 61, the aligning/pressing means 64, and the transport roller 77 are driven for rotation by the drive force transmitted from the rotational driving source 82 to the respective shaft members of the feed roller 61, aligning/pressing means 64, and transport roller 77 via the transmitting means 83.

The aligning/pressing means 64 is disposed on the downstream side of the tray 62 as viewed in the sheet feeding direction B, and on the side opposite from the feed roller 61 across the sheets 67 held between the feed roller 61 and the abutting portion 72*c*. In the present embodiment, two such aligning/pressing means 64 are arranged spaced apart from each other in the width direction C, and the feed roller 61 is mounted in such a manner as to interpose between the two aligning/pressing means 64.

Each aligning/pressing means 64 comprises a sheet aligning/pressing portion 85 for separating the remaining sheets 67*c* from the feed roller 61 and for aligning the leading edges of the leftover sheets 67*b*, and a separator plate pressing portion 86 for separating the abutting portion 72*c* from the feed roller 61 by displacing the separator plate 72 in the separator plate separating direction E2. The sheet aligning/pressing portion 85 includes a sheet pressing portion 87 and a sheet aligning portion 88.

The sheet pressing portion 87 is a sheet separating means for displacing the remaining sheets 67*c* in a direction away from the feed roller 61 when the one sheet 67*a* is transported to the position of the transporting means, that is, the target position, reaching the transport roller 77 and the pinch roller 78. The sheet pressing portion 87 is a member extending in one direction, whose one end 87*a* is fixed to the sheet aligning/pressing portion 85, and whose other end 87*b* is a free end rotatable about the axis L66 of the common drive shaft member 66.

The sheet pressing portion 87 is disposed adjacent to the feed roller 61, and displaces the sheets 67 near the feed roller 61 by pressing them from the side adjacent to the feed roller 61. More specifically, the sheet pressing portion 87 is disposed adjacent to the feed roller 61 in the width direction C, and displaces the sheets 67 by pressing the sheets, more specifically, the downstream ends of the sheets 67 as viewed in the sheet feeding direction B, from the side adjacent to the feed roller 61 in an area near the position where the sheets 67 are held between the feed roller 61 and the lifting plate 68. Since, regardless of the number of remaining sheets 67*c*, the remaining sheets 67*c* excluding the one sheet 67*a* can be reliably separated from the feed roller 61 by displacing them in the direction away from the feed roller 61, the desired separation can be achieved.

The sheet pressing portion 87 is formed so that, when the sheet pressing portion 87 presses the remaining sheets 67*c* from the side adjacent to the feed roller 61, the spacing between the sheet pressing portion 87 and the sheets 67, near the other end 87*b*, gradually becomes larger from one end 87*a* toward the other end 87*b*, and so that the portion of the other end 87*b* that presses the sheets 67 protrudes toward the sheets 67.

The sheet aligning portion 88 is a limiting means for preventing the remaining sheets 67*c*, excluding the one sheet 67*a*, from moving downstream in the sheet feeding direction B when the one sheet is advanced to the target position. In the present embodiment, since the sheet pressing portion 87 and the sheet aligning portion 88 are formed from the same member, and as such are integrally disposed, the sheet aligning portion 88 as well as the sheet pressing portion 87 is located adjacent to the feed roller 61.

The sheet aligning portion 88 has a flat surface substantially vertical to the direction in which the sheet pressing portion 87 extends; the flat surface is formed in such a manner as to face the space sandwiched between the sheet pressing portion 87 and the separator plate pressing portion 86 to be described hereinafter. When the sheet pressing portion 88 presses the remaining sheets 67*c* from the side adjacent to the feed roller 61, the sheet aligning portion 88 is positioned so that its flat surface faces the leftover sheets 67*b*.

The sheet aligning portion 88 aligns the leading edges, or more specifically, the downstream ends as viewed in the sheet feeding direction B, of the leftover sheets 67*b* which are the sheets fed to the separating means 63 from the remaining sheets 67*c* by the feed roller 61 and separated from the one sheet 67*a* by the separating means 63.

The separator plate pressing portion 86 is an abutting portion separating means for moving the abutting portion 72*c* in a direction away from the feed roller 61 so as to release the holding of the sheets 67 by the feed roller 61 and the abutting portion 72*c* when the one sheet 67*a* has reached the target position. By moving the abutting portion 72*c* in a direction away from the feed roller 61, the separator plate pressing portion 86 causes the separator plate 72 to move away from the feed roller 61.

More specifically, the separator plate pressing portion 86 is formed extending halfway along the circumferential surface of the common drive shaft member 66. When the separator plate pressing portion 86 is turned, one circumferential end 86*a* of the separator plate pressing portion 86 presses the protruding piece 72*d* of the separator plate 72, causing the abutting portion 72*c* to move in the separator plate separating direction E2, and releases the pressing to the protruding piece 72*d*, causing the abutting portion 72*c* to move in the separator plate biasing direction E1.

The sheet pressing portion 87 and the separator plate pressing portion 86 are integrally disposed. When the sheet aligning/pressing portion 85 is turned, the sheet pressing portion 87 is displaced with its other end 87*b* sliding along the surface of the one sheet 67*a* that faces the separating means 63, and one surface of the sheet pressing portion 87 to be positioned opposite the sheets 67 pushes the leading edges of the leftover sheets 67*b* toward the upstream side of the sheet feeding direction B. The leading edges of the leftover sheets 67*b*, after being displaced along the one surface of the sheet pressing portion 87, are aligned and supported by the separator plate pressing portion 86.

By forming the aligning/pressing means 64 as described above, when the one sheet 67*a* has reached the target position, the remaining sheets 67*c* can be displaced in a direction away from the feed roller 61, while also moving the abutting portion 72*c* in a direction away from the feed roller 61 so as to release the holding of the sheets 67 by the feed roller 61 and the abutting portion 72*c*; at the same time, the movement of the remaining sheets 67*c* in the downstream direction along the sheet feeding direction B can be restrained. Thus, the separation of the remaining sheets 67*c* from the feed roller 61, the separation of the abutting portion 72*c* from the feed roller 61, and the restraining of the movement of the remaining sheets 67*c* in the downstream direction along the sheet feeding direction B can be accomplished at the same time.

When the sheet pressing portion 87 and the sheet aligning portion 88 are formed as described above, since the leading edges of the leftover sheets 67*b* are guided to the sheet aligning portion 88 by the sheet pressing portion 87, the leading edges of the leftover sheets 67*b* can be aligned by the sheet aligning portion 88, even when the holding of the leftover sheets 67*b* by the feed roller 61 and the abutting portion 72*c* is released. Accordingly, even when the holding of the leftover sheets 67*b* by the feed roller 61 and the abutting portion 72*c* is released, loosening the leftover sheets 67*b*, and their leading edges are not properly aligned, or more specifically, the sheets are skewed with respect to the sheet feeding direction B, the leading edges of the leftover sheets 67*b* can be properly aligned by the sheet aligning portion 88. In this way, the sheets can be set ready for transportation to the transport roller 77 and the pinch roller 78, and the stability of the sheet feeding operation can thus be enhanced.

Further, the sheet pressing portion 87 is formed so that, when the sheet pressing portion 87 presses the remaining sheets 67*c* from the side adjacent to the feed roller 61, the spacing between the sheet pressing portion 87 and the sheets 67, near the other end 87*b*, gradually becomes larger from one end 87*a* toward the other end 87*b*, and so that the portion of the other end 87*b* that presses the sheets 67 protrudes toward the sheets 67. Accordingly; even when the sheet pressing portion 87 presses the remaining sheets 67*c* near the feed roller 61, the leftover sheets 67*b* can be prevented from being bent by the sheet pressing portion 87, preventing ill effect from being caused to the feed operation performed using the leftover sheets 67*b*.

Figure 4:
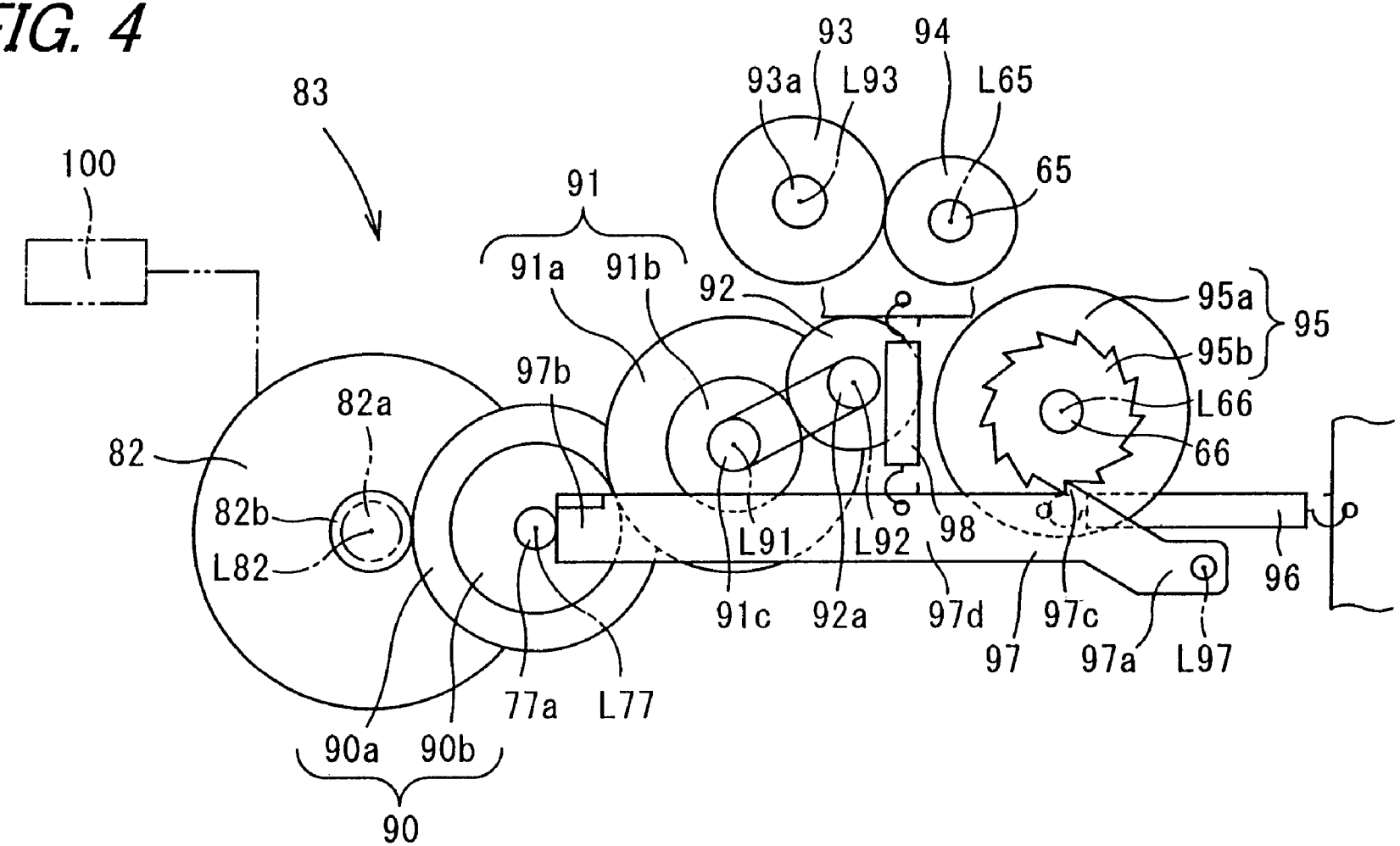
FIG. 4 is a diagram for explaining the construction of a transmitting means in an initial condition.
Figure 5:
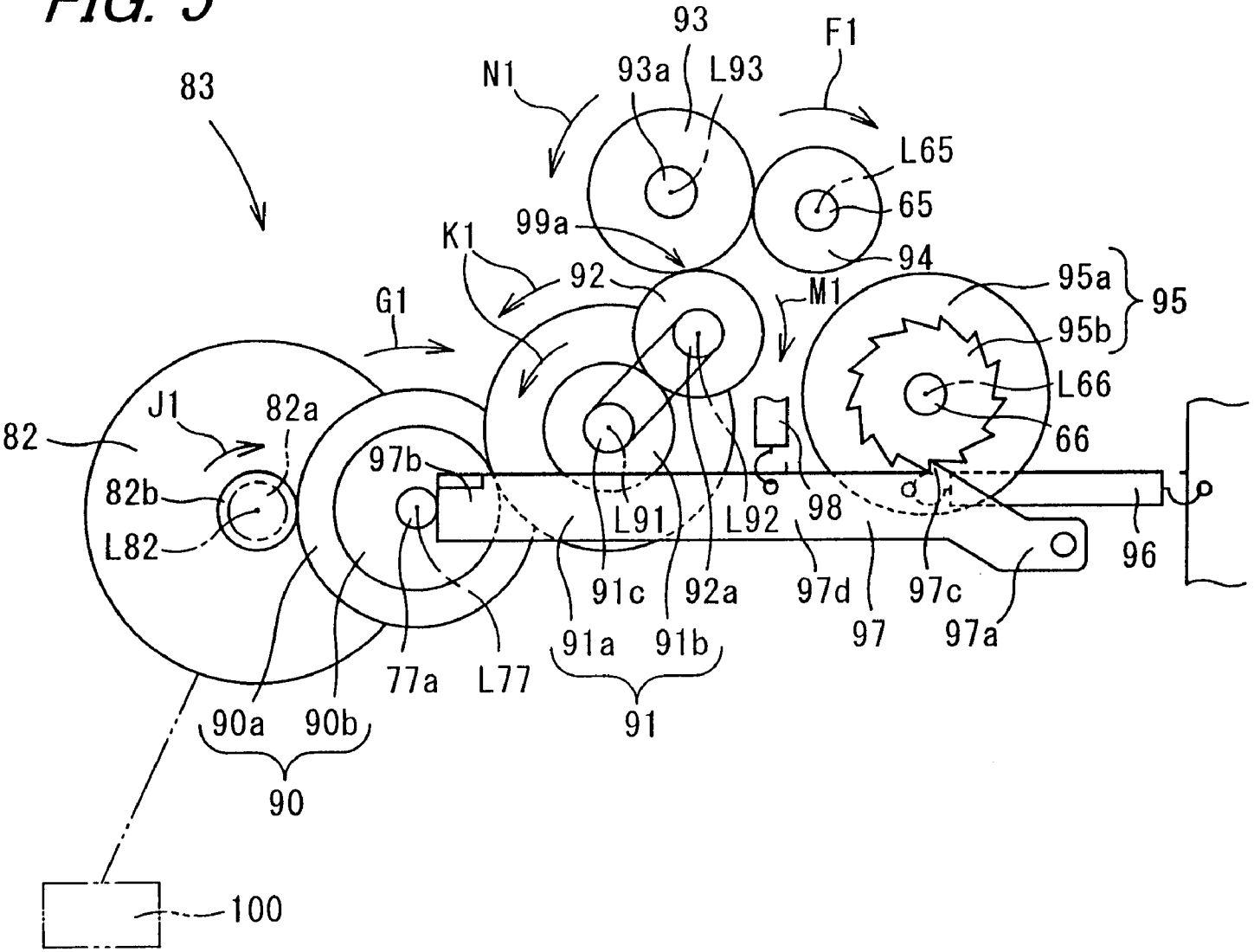
FIG. 5 is a diagram for explaining the operation of the transmitting means in a sheet feed mode.
Figure 6:
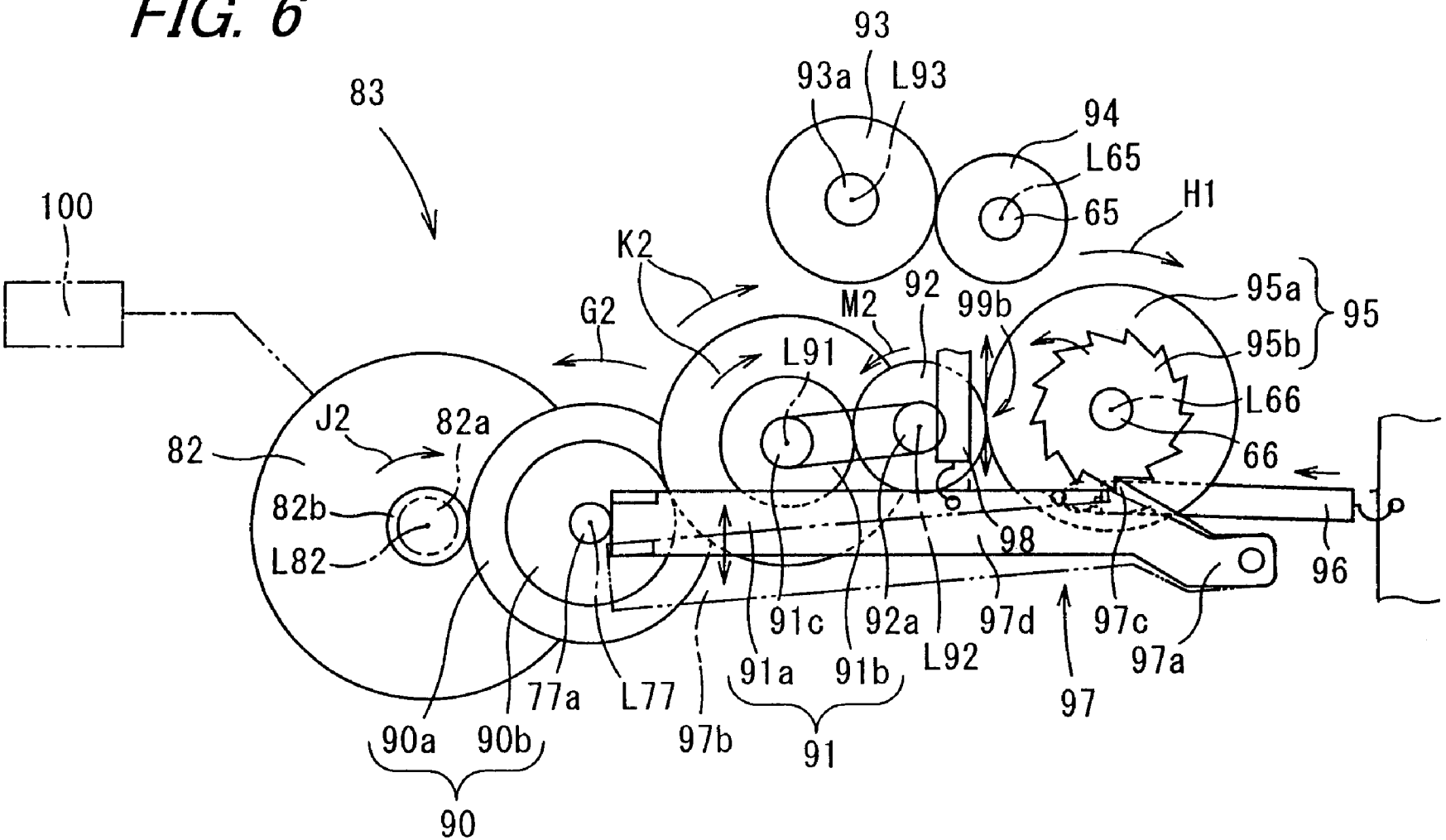
FIG. 6 is a diagram for explaining the operation of the transmitting means in an aligning/pressing mode.
Figure 7:
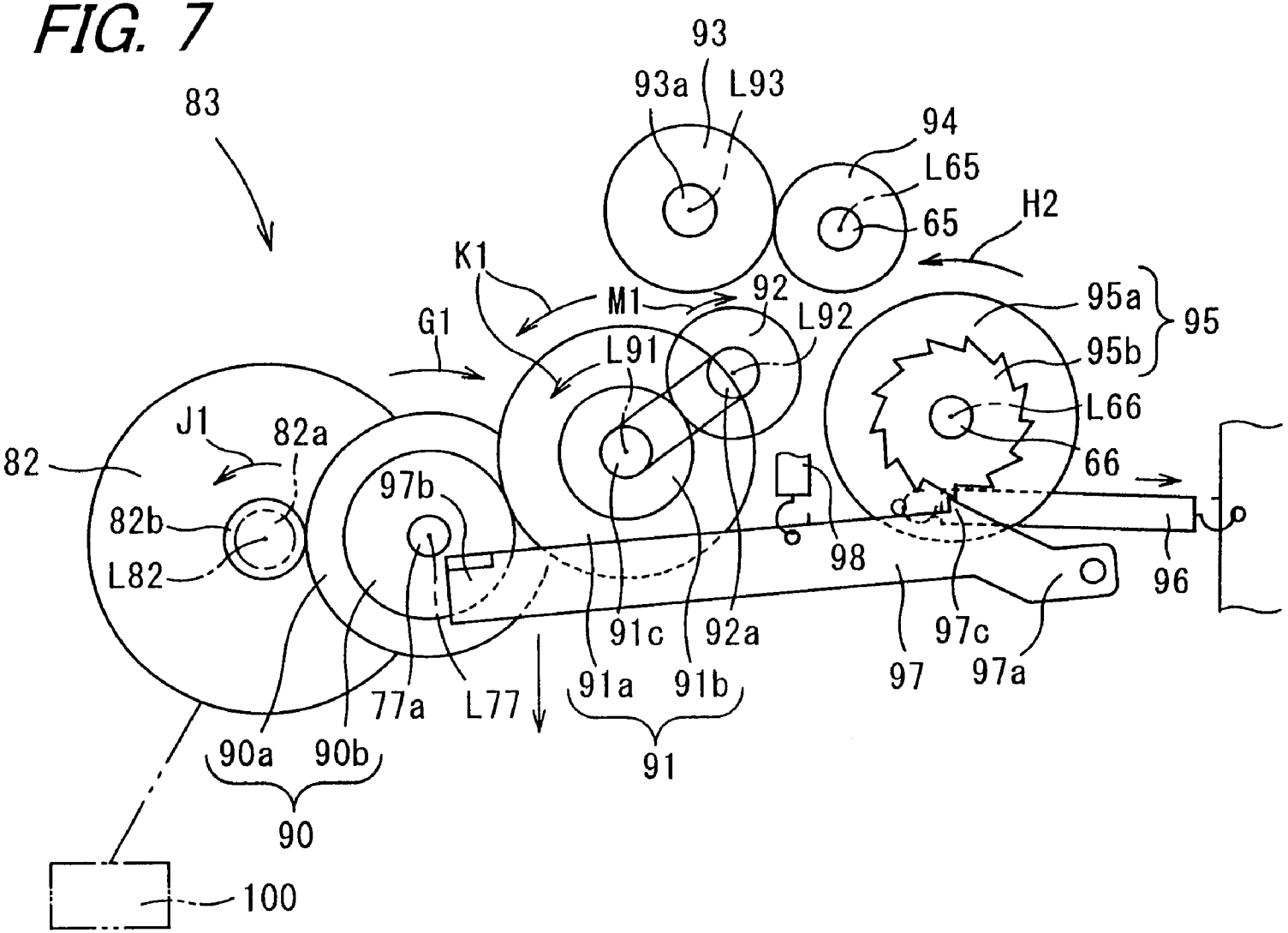
FIG. 7 is a diagram for explaining the operation of the transmitting means in an aligning/pressing release mode.
Figure 8:
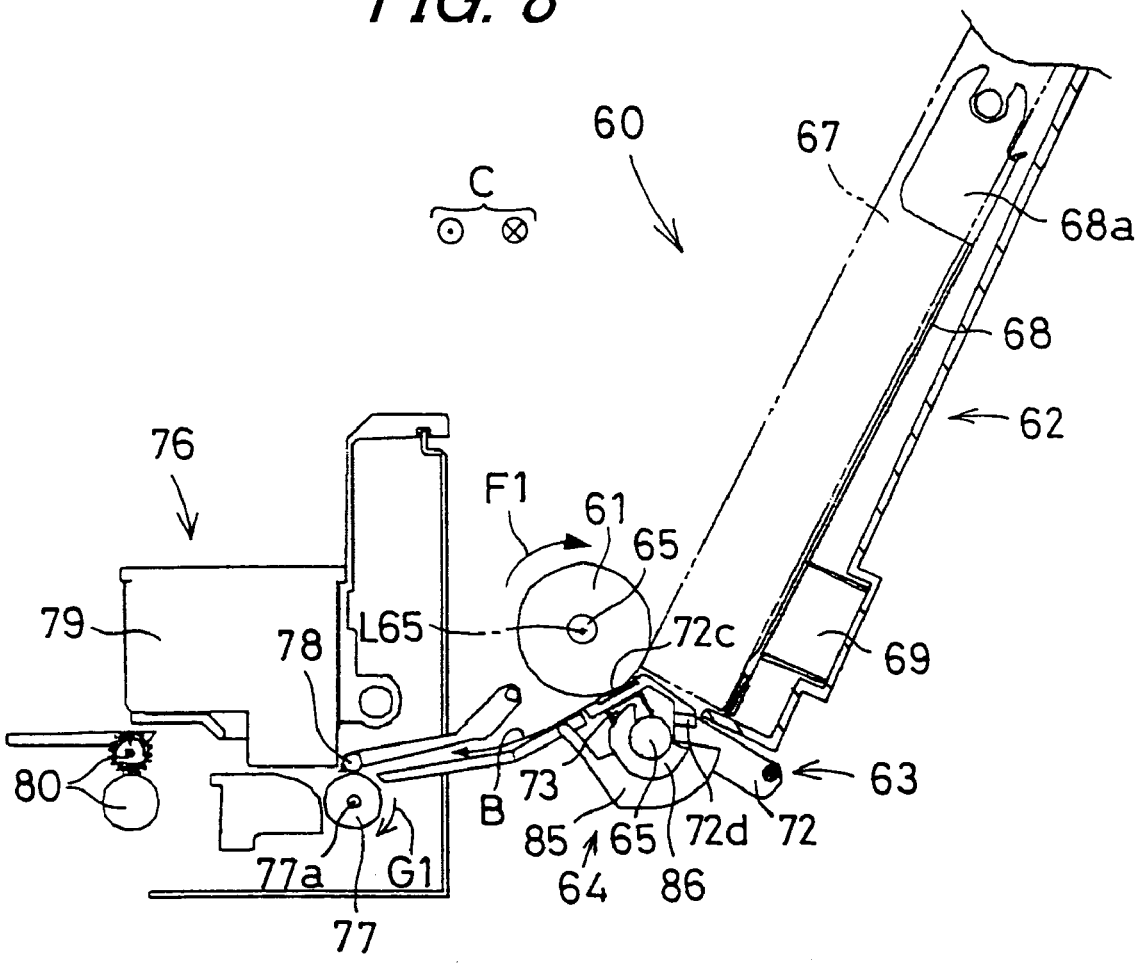
FIG. 8 is a diagram for explaining the operation of a feed roller and a transport roller in the sheet feed mode.
Figure 9:
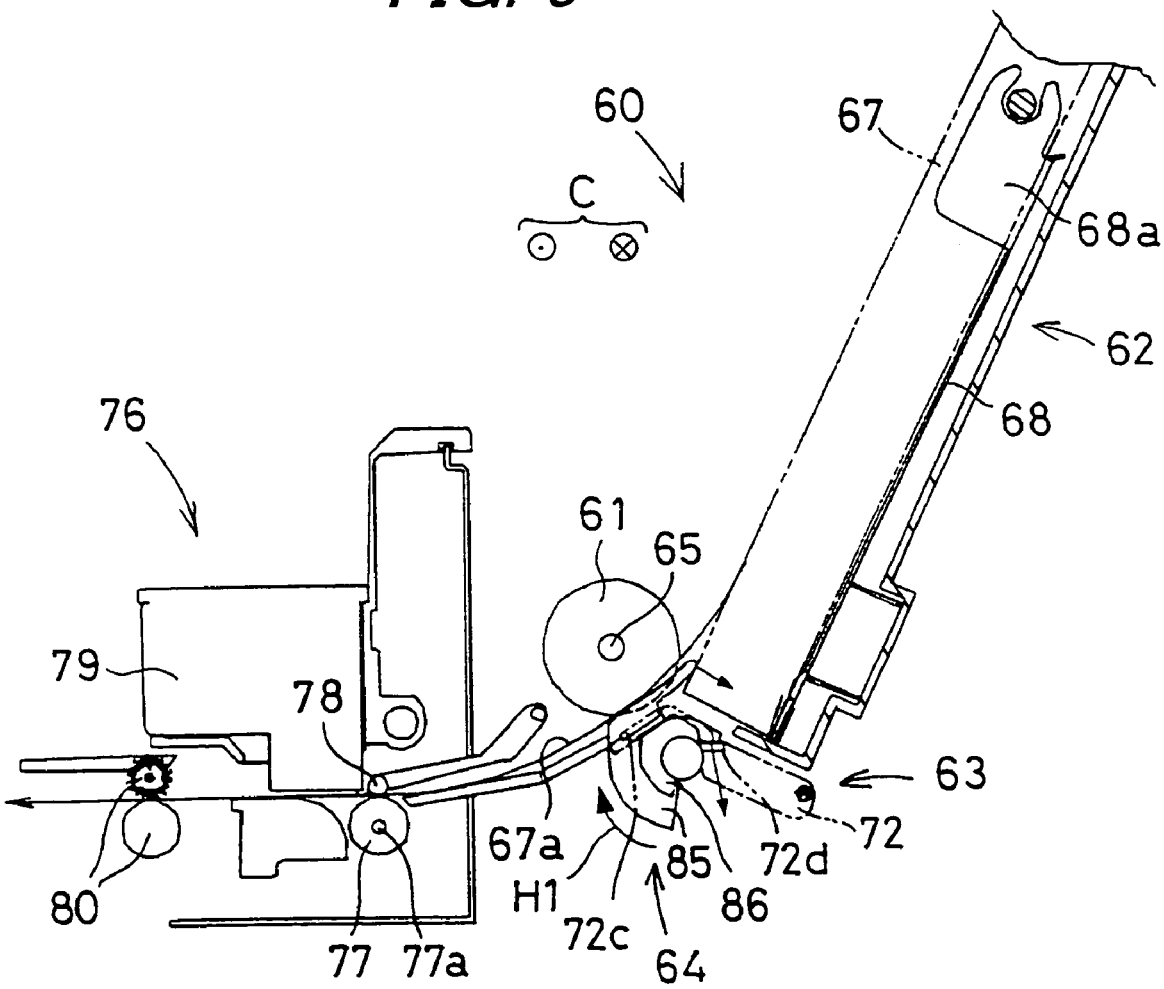
FIG. 9 is a diagram for explaining the operation of an aligning/pressing means in the aligning/pressing mode.
Figure 10:
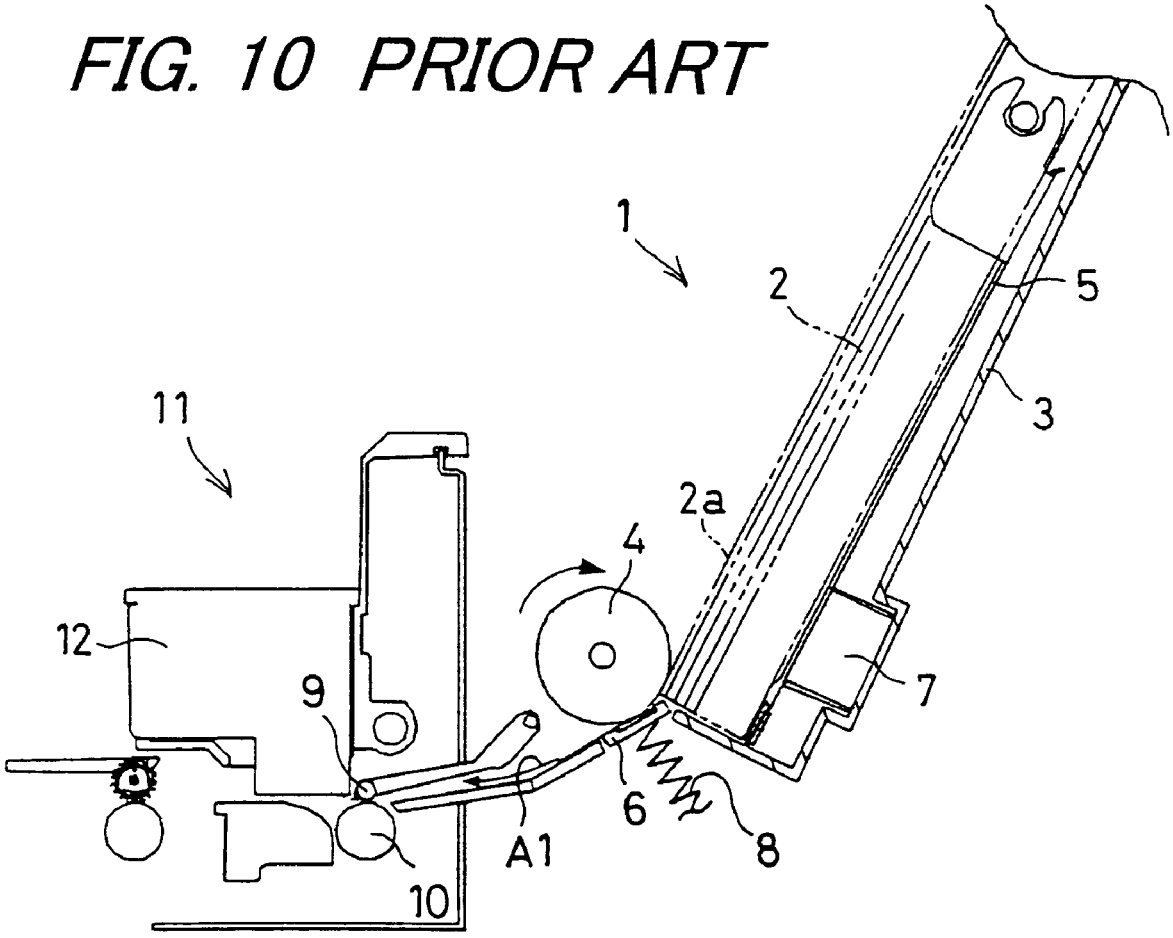
FIG. 10 PRIOR ART
FIG. 10 is a cross sectional view showing a first sheet feeding apparatus according to the related art.
Figure 11:
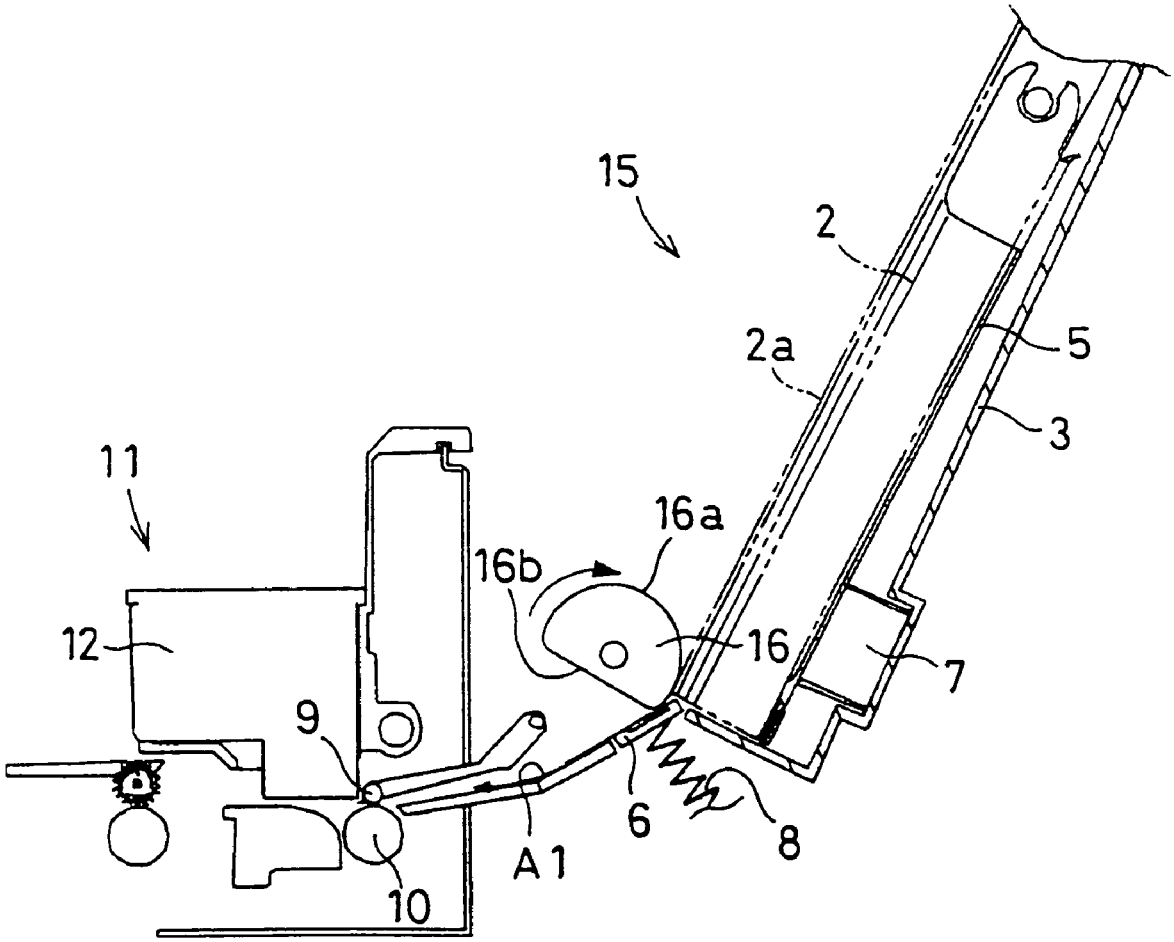
FIG. 11 PRIOR ART
FIG. 11 is a cross sectional view showing a second sheet feeding apparatus according to the related art.
Figure 12:
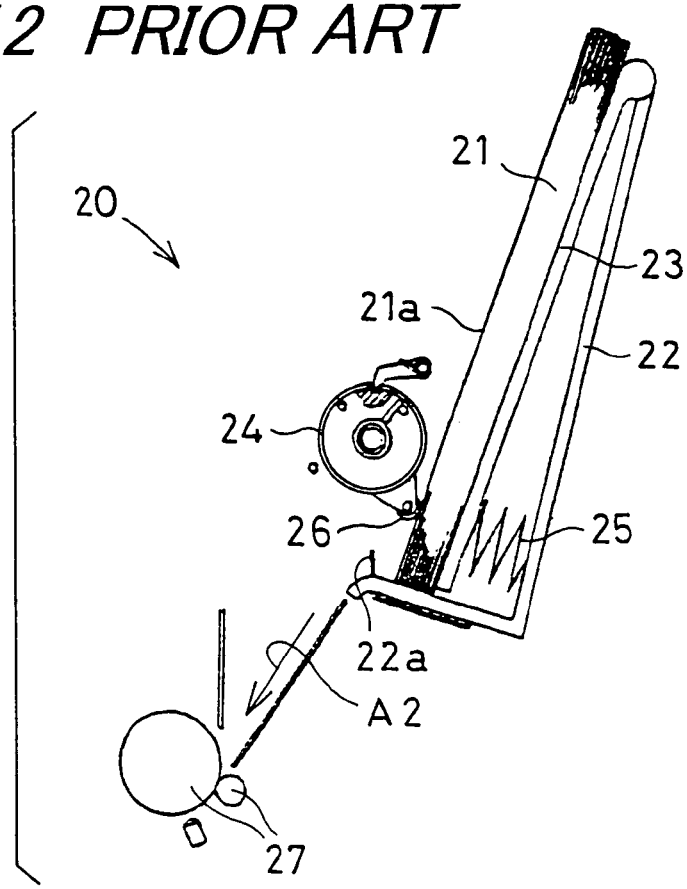
FIG. 12 PRIOR ART
FIG. 12 is a cross sectional view showing a third sheet feeding apparatus according to the related art.
Figure 13:
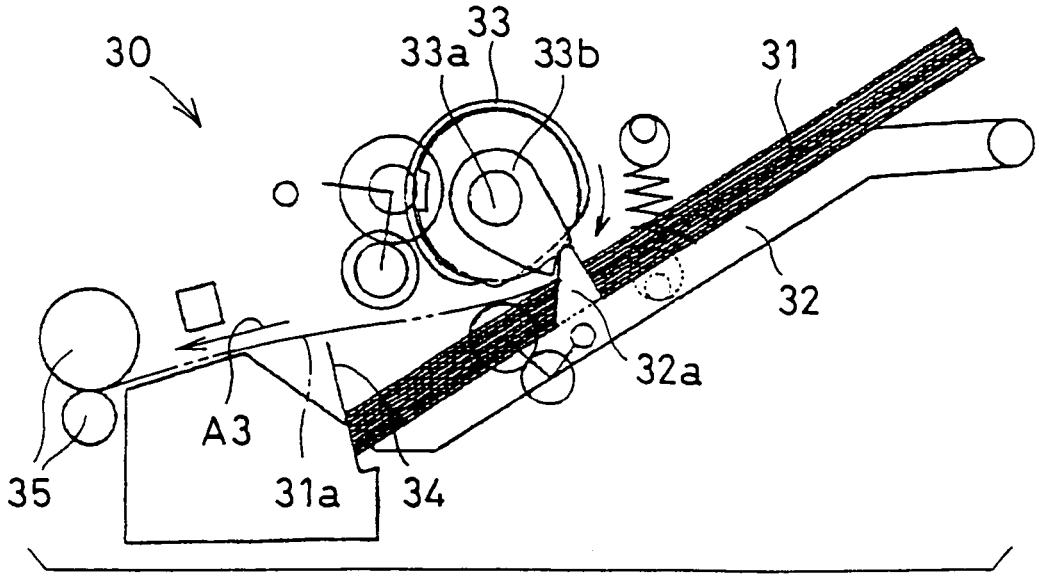
FIG. 13 PRIOR ART
FIG. 13 is a cross sectional view showing a fourth sheet feeding apparatus according to the related art.
Figure 14:
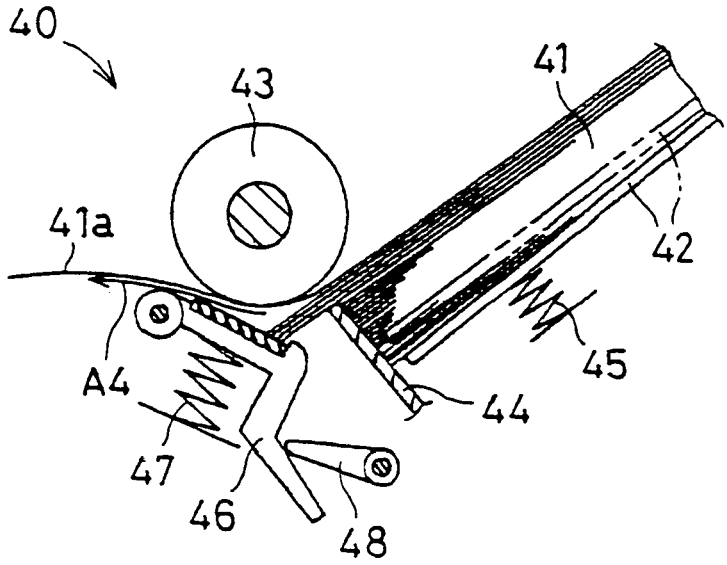
FIG. 14 PRIOR ART
FIG. 14 is a cross sectional view showing a fifth sheet feeding apparatus according to the related art.
Figure 15:
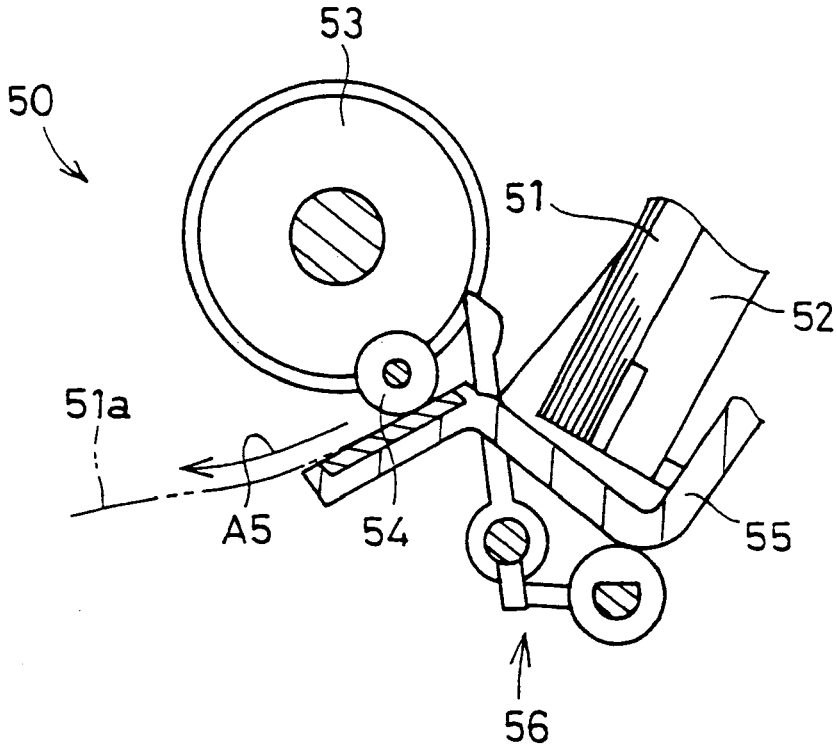
FIG. 15 PRIOR ART
FIG. 15 is a cross sectional view showing a sixth sheet feeding apparatus according to the related art.

FIG. 4 is a diagram for explaining the construction of the transmitting means 83 in an initial condition. FIG. 5 is a diagram for explaining the operation of the transmitting means 83 in a sheet feed mode. FIG. 6 is a diagram for explaining the operation of the transmitting means 83 in an aligning/pressing mode. FIG. 7 is a diagram for explaining the operation of the transmitting means 83 in an aligning/pressing release mode. FIG. 8 is a diagram for explaining the operation of the feed roller 61 and the transport roller 77 in the sheet feed mode. FIG. 9 is a diagram for explaining the operation of the aligning/pressing means 64 in the aligning/pressing mode. In FIGS. 6 to 9, a transport input gear 90, a sun gear 91, a planet gear 92, an intermediate gear 93, a feed input gear 94, and a first common input gear 95*a* of a common input gear 95, described hereinafter, are each shown by a pitch circle for ease of illustration. The transmitting means 83 comprises the transport input gear 90, the sun gear 91, the planet gear 92, the intermediate gear 93, the feed input gear 94, and the common input gear 95, plus a first spring member 96, an engaging member 97, and a second spring member 98.

The initial condition refers to the condition in which the sheets 67 are held between the feed roller 61 and the lifting plate 68, and the planet gear 92 is located between a feed input position 99*a* and a common input position 99*b* so that the drive force from the rotational driving source 82 will not be transmitted via the transmitting means 83 to the feed shaft member 65 nor to the common drive shaft member 66. The feed input position 99*a* is where the planet gear 92 transmits its rotational force to the feed input gear 94, and the common input position 99*b* is where the planet gear 92 transmits its rotational force to the common input gear 95.

The rotational driving source 82 has a drive input gear 82*b* which is driven for rotation by the rotation of an output shaft 82*a*. The drive input gear 82*b* is a gear with teeth formed around the circumference thereof, and rotates in an interlocking fashion with the output shaft 82*a* of the rotational driving source 82.

The transport input gear 90 has teeth formed on the circumference thereof, and comprises a first transport input gear 90*a* and a second transport input gear 90*b*. The first transport input gear 90*a* is a gear the diameter of whose pitch circle, for example, is larger than that of the second transport input gear 90*b*. The first and second transport input gears 90*a* and 90*b* are respectively connected to the transport shaft member 77*a*, and rotate in an interlocking fashion with the transport shaft member 77*a*. The first transport input gear 90*a* is mounted in meshing engagement with the drive input gear 82*b*.

The sun gear 91 is a gear with teeth formed on the circumference thereof, and comprises a first sun gear 91*a* and a second sun gear 91*b*. The first sun gear 91*a* is a gear the diameter of whose pitch circle, for example, is larger than that of the second sun gear 91*b*. The first and second sun gears 91*a* and 91*b* rotate in an interlocking fashion with a sun shaft member 91*c* supported rotatably about a predetermined axis L91. The first sun gear 91*a* is mounted in meshing engagement with the second transport input gear 91*b*.

The planet gear 92 is a gear with teeth formed on the circumference thereof, and rotates in an interlocking fashion with a planet shaft member 92*a* supported rotatably about a predetermined axis L92. The planet gear 92 is mounted in meshing engagement with the second sun gear 91*b*, and the planet shaft member 92*a* is connected to the sun shaft member 91*c* by a connecting member such as a belt. The planet gear 92 thus transmits the rotational force to the feed input gear 94. More specifically, the planet gear 92 is mounted so as to be movable around the second sun gear 91*b* between the feed input position 99*a*, where the planet gear 92 engages with the intermediate gear 93 and transmits the rotational force to the feed input gear 94 via the intermediate gear 93, and the common input position 99*b*, where the planet gear 92 engages with the common input gear 95, or more specifically, the first common input gear 95*a*.

The intermediate gear 93 has teeth formed on the circumference thereof, and rotates in an interlocking fashion with an intermediate shaft member 93*a* supported rotatably about a predetermined axis L93. The feed input gear 94 rotates in an interlocking fashion with the feed shaft member 66. The feed input gear 94 has teeth formed on the circumference thereof, and is mounted in an area surrounding the sun gear 91. The intermediate gear 93 is also mounted in the area surrounding the sun gear 91; more specifically, the intermediate gear 93 is held in meshing engagement with the feed input gear 94, and is located in a position that is nearer to the planet gear 92 than the feed input gear 94 is, and that allows the intermediate gear 93 to be engaged with the planet gear 92 moving around the second sun gear 91*b*.

The common input gear 95 is mounted spaced apart from the feed input gear 94 in the area surrounding the sun gear 91, and rotates in an interlocking fashion with the common drive shaft member 66. The common input gear 95 comprises the first common input gear 95*a*, which is a partially toothed gear with teeth formed only on a portion of its circumference, and a second common input gear 95*b*, which is a ratchet wheel with pawls formed around the circumference thereof. The first common input gear 95*a* is mounted in a position where the planet gear 92 moving around the second sun gear 91*b* is brought into engagement.

The first common input gear 95*a* is provided with the first spring member 96 which exerts a pulling force so that the first common input gear 95*a* rotates in the direction opposite to the aligning/pressing rotation direction H1 when the first common input gear 95*a* rotates with the rotation of the common drive shaft member 66 in the aligning/pressing rotation direction H1. One end of the first spring member 96 is connected to the first common input gear 95*a*, and the other end is connected, for example, to the casing of the drive force transmission mechanism 81.

The engaging member 97 is mounted so as to be angularly displaceable at its one end 97*a* about an axis L97 extending parallel to the width direction C, and includes an engaging portion 97*c* which engages with a pawl provided on the second common input gear 95*b*. With the engaging portion 97*c* engaging with the pawl of the second input gear 95*b*, the engaging member 97 allows the common drive shaft member 66 to rotate only in the first aligning/pressing rotation direction H1. The second spring member 98 is provided at an intermediate point 97*d* between one end 97*a* and the other end 97*b* of the engaging member 97.

One end of the second spring member 98 is connected to the intermediate point 97*d* of the engaging member 97 and the other end is connected, for example, to the casing of the drive force transmission mechanism 81. The second spring member 98 exerts a pulling force in the direction opposite to the angularly displacing direction of the engaging member 97 when the engaging member 97 is angularly displaced about its axis.

In the feed mode, the feed roller 61 is rotated to feed the sheets 67 downstream in the sheet feeding direction B. As shown in FIG. 5, the rotational driving source 82 drives the output shaft 82*a* to rotate in a first driving direction J1, and the drive input gear 82*b* thus rotates in the first driving direction J1 with the rotation of the output shaft 82*a*. The first driving direction J1 is the direction in which the output shaft 82*a* rotates so as to cause the planet gear 92 to move from the common input position 99*b* toward the feed input position 99*a*.

When the drive input gear 82*b* rotates in the first driving direction J1, the first transport input gear 90*a* engaged with the drive input gear 82*b* rotates in the first transport rotation direction G1, causing the transport shaft member 77*a* to rotate in the first transport rotation direction G1. In this way, the drive force from the rotational driving source 82 is transmitted via the transmitting means 83 to the transport shaft member 77*a*, and the transport roller 77 rotates in the first transport rotation direction G1, as shown in FIG. 8. Further, when the transport shaft member 77*a* rotates in the first transport rotation direction G1, the second transport input gear 90*b* also rotates in the first transport rotation direction G1.

When the second transport input gear 90*b* rotates in the first transport rotation direction G1, the first sun gear 91*a* engaged with the second transport input gear 90*b* rotates in a first sun rotation direction K1, causing the sun shaft member 91*c* to rotate in the first sun rotation direction K1. The first sun rotation direction K1 is the direction that coincides with the first transport rotation direction G1 at the position where the first sun gear 91*a* engages with the second transport input gear 90*b*. When the sun shaft member 91*c* rotates in the first sun rotation direction K1, the second sun gear 91*b* also rotates in the first sun rotation direction K1.

When the second sun gear 91*b* rotates in the first sun rotation direction K1, the planet gear 92 engaged with the second sun gear 91*b* rotates in a first planet rotation direction M1, while moving around the second sun gear 91*b* in the first sun rotation direction K1. The first planet rotation direction M1 is the direction in which the planet gear 92 rotates about its axis L92 when the second sun gear 91*b* rotates in the first sun rotation direction K1.

When the planet gear 92 moves around the second sun gear 91*b* in the first sun rotation direction K1, the planet gear 92 reaches the feed input position 99*a*, where the planet gear 92 engages with the intermediate gear 93. As a result, the intermediate gear 93 rotates in a first intermediate rotation direction N1. The first intermediate rotation direction N1 is the direction that coincides with the first planet rotation direction M1 at the position where the planet gear 92 engages with the intermediate gear 93.

When the intermediate gear 93 rotates in the first intermediate rotation direction N1, the feed input gear 94 engaged with the intermediate gear 93 rotates in the first feed rotation direction F1, causing the feed shaft member 65 to rotate in the first feed rotation direction F1. In this way, by transmitting the rotational force of the planet gear 92 via the intermediate gear 93 to the feed input gear 94, the drive force from the rotational driving source 82 is transmitted via the transmitting means 83 to the feed shaft member 65. As a result, the feed roller 61 rotates in the first feed rotation direction F1, as shown in FIG. 8, to feed the sheets 67 stacked on the lifting plate 68 in the downstream direction along the sheet feeding direction B.

When the one sheet 67*a* reaches the target position, operation is performed in accordance with the aligning/pressing mode. In the aligning/pressing mode, the one sheet 67*a* is transported downstream in the sheet feeding direction B by the transport roller 77, getting ready for feed operation using the leftover sheets 67*b*.

As shown in FIG. 6, the rotational driving source 82 drives the output shaft 82*a* to rotate in a second driving direction J2 opposite to the first driving direction J1, and the drive input gear 82*b* thus rotates in the second driving direction J2 with the rotation of the output shaft 82*a*. The second driving direction J2 is the direction in which the output shaft 82*a* rotates so as to cause the planet gear 92 to move from the feed input position 99*a* toward the common input position 99*b*.

When the drive input gear 82*b* rotates in the second driving direction J2, the first transport input gear 90*a* engaged with the drive input gear 82*b* rotates in the second transport rotation direction G2, causing the transport shaft member 77*a* to rotate in the second transport rotation direction G2. The second transport rotation direction G2, which is opposite to the first transport rotation direction G1, is the direction in which the transport shaft member 77*a* rotates so as to cause the transport roller 77 to transport the one sheet 67*a* downstream in the sheet feeding direction B.

When the transport shaft member 77*a* rotates in the second transport rotation direction G2 as described above, the transport roller 77 rotates in the second transport rotation direction G2 to transport the one sheet 67*a* downstream in the sheet feeding direction B. When the transport shaft member 77*a* rotates in the second transport rotation direction G2, the second transport input gear 90*b* also rotates in the second transport rotation-direction G2.

When the second transport input gear 90*b* rotates in the second transport rotation direction G2, the first sun gear 91*a* engaged with the second transport input gear 90*b* rotates in a second sun rotation direction K2, causing the sun shaft member 91*c* to rotate in the second sun rotation direction K2. The second sun rotation direction K2, which is opposite to the first sun rotation direction K1, is the direction that coincides with the second transport rotation direction G2 at the position where the first sun gear 91*a* engages with the second transport input gear 90*b*. When the sun shaft member 91*c* rotates in the second sun rotation direction K2, the second sun gear 91*b* also rotates in the second sun rotation direction K2.

When the second sun gear 91*b* rotates in the second sun rotation direction K2, the planet gear 92 engaged with the second sun gear 91*b* rotates in a second planet rotation direction M2, while moving around the second sun gear 91*b* in the second sun rotation direction K2. The second planet rotation direction M2 is the direction in which the planet gear 92 rotates about its axis L92 when the second sun gear 91*b* rotates in the second sun rotation direction K2.

When the planet gear 92 moves around the second sun gear 91*b* in the second sun rotation direction K2, the planet gear 92 reaches the common input position 99*b*, where the planet gear 92 engages with the first common input gear 95*a*. As a result, the first common input gear 95*a* rotates in the first aligning/pressing rotation direction H1.

When the first common input gear 95*a* rotates in the first aligning/pressing rotation direction H1, the common drive shaft member 66 rotates in the first aligning/pressing rotation direction H1. When the common drive shaft member 66 rotates in the first aligning/pressing rotation direction H1, the aligning/pressing means 64 rotates in the first aligning/pressing rotation direction H1, as shown in FIG. 9.

When the aligning/pressing means 64 rotates in the first aligning/pressing rotation direction H1 as described above, the sheet pressing portion 87 presses the remaining sheets 67*c* from the side adjacent to the feed roller 61 to separate them from the feed roller 61, while pushing back the leftover sheets 67*b* toward the upstream side of the separating means 63 as viewed in the sheet feeding direction B. The sheet aligning portion 88 aligns and supports the leading edges of the leftover sheets 67*b* pushed back by the sheet pressing portion 87. Further, the separator plate pressing portion 86 presses the protruding portion 72*d* of the separator plate 72 from the side adjacent to the feed roller 61, thus causing the abutting portion 72*c* to move away from the feed roller 61.

When the common drive shaft member 66 rotates in the first aligning/pressing rotation direction H1, the second common input gear 95*b* rotates in the first aligning/pressing rotation direction H1. When the second common input gear 95*b* rotates in the first aligning/pressing rotation direction H1, the engaging portion 97*c* of the engaging member 97 is displaced in such a direction as to disengage from the second common input gear 95*b*, but since pulling force is exerted by the second spring member 98, the engaging portion 97*c*, upon riding over the upstream-side pawl, is displaced in the opposite direction by the pulling force, and moves along the pawl of the second common input gear 95*b*.

Since the first common input gear 95*a* is a partially toothed gear with teeth formed only on a portion of its circumference, the first common input gear 95*a* rotates in the first aligning/pressing rotation direction H1 only when the first common input gear 95*a* is engaged with the planet gear 92. When the first common input gear 95*a* is disengaged from the planet gear 92, the drive force from the rotational driving source 82 is not transmitted; therefore, the first common input gear 95*a*, the common drive shaft member 66, and the second common input gear 95*b* do not rotate in the first aligning/pressing rotation direction H1.

Further, the first common input gear 95*a* is subjected to the pulling force of the first spring member 96 so that the first common input gear 95*a* rotates in a second aligning/pressing rotation direction H2. The second aligning/pressing rotation direction H2, which is opposite to the first aligning/pressing rotation direction H1, is the direction in which the common drive shaft member 66 rotates so as to cause the aligning/pressing means 64 to move the remaining sheets 67*c* toward the feed roller 61, while also causing the abutting portion 72*c* to move toward the feed roller 61.

Though the first common input gear 95*a* is subjected to the pulling force of the first spring member 96 as described above, the engaging portion 97*c* of the engaging member 97 engages with the pawl of the second common input gear 95*b* so as to allow the second common input gear 95*b* to rotate only in the first aligning/pressing rotation direction H1. This prevents the first common input gear 95*a*, the common drive shaft member 66, and the second common input gear 95*b* from rotating in the second aligning/pressing rotation direction H2. In this way, the aligning/pressing means 64 can simultaneously maintain the condition in which the remaining sheets 67*c* are separated from the feed roller 61, the condition in which the leading edges of the leftover sheets 67*b* are aligned, and the condition in which the abutting portion 72*c* is separated from the feed roller 61.

In the circumferential portion of the first common input gear 95*a* other than the toothed portion thereof, the first common input gear 95*a* is disengaged from the planet gear 92, but since the drive force from the rotational driving source 82 is transmitted to the transport roller 77, the one sheet 67*a* is transported downstream in the sheet feeding direction B by the transport roller 77.

In a state where the holding of the one sheet 67*a* by the feed roller 61 and the abutting portion 72*c* is released, the one sheet 67*a* is transported downstream in the sheet feeding direction B by the transport roller 77, and an image is formed thereon. In this way, the one sheet 67*a* is transported downstream in the sheet feeding direction B without being subjected to back tension, a pulling force that would be exerted in opposition to the sheet feeding direction B if the one sheet 67*a* remained held between the feed roller 61 and the abutting portion 72*c*. Since the one sheet 67*a* is transported accurately and stably by the transport roller 77, a high quality image can be formed.

When the image formation on the one sheet 67*a* is completed, operation is performed in accordance with the aligning/pressing release mode. In the aligning/pressing release mode, the aligning/pressing means 64 is released from the operation in the aligning/pressing mode, and the planet gear 92 is moved back to its initial position.

As shown in FIG. 7, the rotational driving source 82 drives the output-shaft 82*a* to rotate in the first driving direction J1, and the drive input gear 82*b* thus rotates in the first driving direction J1 with the rotation of the output shaft 82*a*. When the drive input gear 82*b* rotates in the first driving direction J1, the first transport input gear 90*a* engaged with the drive input gear 82*b* rotates in the first transport rotation direction G1, causing the transport shaft member 77*a* to rotate in the first transport rotation direction G1.

When the transport shaft member 77*a* rotates in the first transport rotation direction G1, the transport roller 77 rotates in the first transport rotation direction G1. Further, when the transport shaft member 77*a* rotates in the first transport rotation direction G1, the second transport input gear 90*b* also rotates in the first transport rotation direction G1.

When the second transport input gear 90*b* rotates in the first transport rotation direction G1, the first sun gear 91*a* engaged with the second transport input gear 90*b* rotates in the first sun rotation direction K1, causing the sun shaft member 91*c* to rotate in the first sun rotation direction K1. When the sun shaft member 91*c* rotates in the first sun rotation direction K1, the second sun gear 91*b* also rotates in the first sun rotation direction K1.

When the second sun gear 91*b* rotates in the first sun rotation direction K1, the planet gear 92 engaged with the second sun gear 91*b* rotates in the first planet rotation direction M1, while moving around the second sun gear 91*b* in the first sun rotation direction K1. In synchronism with the rotation of the planet gear 92 in the first planet rotation direction M1, the pawl of the second common input gear 95*b* is disengaged from the engaging portion 97*c* of the engaging member 97. The disengagement is accomplished, for example, by pressing the engaging member 97 using a pressing member such as a carriage (not shown) in the direction opposite to the direction in which the pulling force of the second spring member 98 is exerted on the engaging member 97.

After the disengagement, the pushing to the engaging member 97 by the pressing member is released, thus allowing the engaging portion 97*c* of the engaging member 97 to engage with the pawl of the second common input gear 95*b*. A control means 100, indicated by an imaginary line, performs control in synchronism with the rotation of the planet gear 92 so that the pressing member pushes the engaging member 97 or releases the pushing. The control means 100 is provided, for example, in the drive force transmission mechanism 81.

When the pawl of the second common input gear 95*b* is disengaged from the engaging portion 97*c* of the engaging member 97 in synchronism with the rotation of the planet gear 92 in the first planet rotation direction M1, the first common input gear 95*a* rotates in the second aligning/pressing rotation direction H2 by the pulling force of the first spring member 96, so that the common drive shaft member 66 rotates in the second aligning/pressing rotation direction H2. As a result, the planet gear 92 is disengaged from the first common input gear 95*a*, and the planet gear 92 is displaced from the common input position 99*b* and moves back to its initial position.

When the common drive shaft member 66 rotates in the second aligning/pressing rotation direction H2, the aligning/pressing means 64 rotates in the second aligning/pressing rotation direction H2. As a result, the remaining sheet 67*c* are moved toward the feed roller 61 and held between the feed roller 61 and the lifting plate 68; at the same time, the abutting portion 72*c* is moved toward the feed roller 61, and the leftover sheets 67*b* are held between the feed roller 61 and the abutting portion 72*c*.

The rotating direction of the rotational driving source 82 in the feed mode, the aligning/pressing mode, and the aligning/pressing release mode is controlled by the control means 100, and the transmitting means 83 operates accordingly.

According to the present embodiment, the lifting plate 68 is mounted so as to be movable toward and away from the feed roller 61, and the plurality of sheets 67 are stacked on the lifting plate 68. The separating means 63 is disposed downstream of the tray 62 in the sheet feeding direction B of the sheets 67, and the abutting portion 72*c* is disposed so as to be movable toward and away from the feed roller 61.

By supporting the plurality of stacked sheets 67 in the tray 62 from the side opposite from the feed roller 61, one sheet 67*a* closest to the feed roller 61 can be elastically pressed against the feed roller 61. When the feed roller 61 is rotated while elastically pressing the one sheet 67*a* against the feed roller 61, sheets 67 are fed downstream in the sheet feeding direction B and elastically held between the abutting portion 72*c* and the feed roller 61.

The sheets 67 are separated by the separating means 63 so that, of the sheets elastically held between the abutting portion 72*c* and the feed roller 61, only the one sheet 67*a* will be fed out by the rotation of the feed roller 61.

When the one sheet 67*a* has been advanced to the target position reaching the transporting means that is disposed downstream in the sheet feeding direction B and comprises the transport roller 77 and the pinch roller 78 for transporting the sheet 67, the sheet separating means, i.e., the sheet pressing portion 87, displaces the remaining sheets 67*c* in a direction away from the feed roller 61 and thus separates the remaining sheets 67*c* from the feed roller 61.

When the one sheet 67*a* has been advanced to the target position, the abutting portion separating means, i.e., the separator plate pressing portion 86, moves the abutting portion 72*c* in a direction away from the feed roller 61, thus releasing the holding of the sheets 67 by the abutting portion 72*c* and the feed roller 61. When the one sheet 67*a* has been advanced to the target position, the remaining sheets 67*c* excluding the one sheet 67*a* are prevented from moving downstream in the sheet feeding direction B by the limiting means, i.e., the sheet aligning portion 87.

As described above, when the one sheet 67*a* has been advanced to the target position, the holding of the sheets 67, including the one sheet 67*a*, by the abutting portion 72*c* and the feed roller 61 is released; since the one sheet 67*a* is no longer held between the abutting portion 72*c* and the feed roller 61, the one sheet 67*a* can be transported with its leading edge held between the transport roller 77 and the pinch roller 78.

This prevents the one sheet 67*a* from being subjected to the pulling force that would be exerted in opposition to the sheet feeding direction B if the one sheet 67*a* remained held between the abutting portion 72*c* and the feed roller 61. Further, when the one sheet 67*a* has reached the target position, and the remaining sheets 67*c* have been displaced in a direction away from the feed roller 61 by the sheet pressing portion 87, the sheet aligning portion 88 prevents the remaining sheets 67*c* from moving downstream in the sheet feeding direction B. As a result, the remaining sheets 67*c* can be prevented from being transported downstream in the sheet feeding direction B together with the one sheet 67*a*.

Accordingly, the accuracy of the feeding operation of the sheets 67 can be improved, that is, the sheets 67 can be reliably fed one sheet at a time, for example, by preventing more than one sheet 67 from being transported simultaneously to the transport roller 77 and the pinch roller 78. Furthermore, the stability of the feeding operation of the sheets 67 can be improved, that is, the sheets can be stably fed, for example, by eliminating such problems as the inability to form a high quality image because of the sheet 67 being fed skewed with respect to the sheet feeding direction B and the inability to feed the sheet 67 downstream in the sheet feeding direction B because of the sheet 67 getting jammed along the path.

Further, according to the present embodiment, the sheet pressing portion 87 as the sheet separating means is provided adjacent to the feed roller 61, and the sheets 67, or more specifically, the remaining sheets 67*c*, are displaced near the feed roller 61 by being pressed from the side adjacent to the feed roller 61. In this way, the remaining sheets 67*c*, excluding the one sheet 67*a* closest to the rotatable feeding means, can be reliably displaced in a direction away from the feed roller 61 and separated from the feed roller 61, regardless of the number of remaining sheets 67*c*.

Furthermore, according to the present embodiment, of the remaining sheets 67*c*, the leftover sheets 67*b* are fed to the separating means 63 by the feed roller 61, and separated from the one sheet 67*a* by the separating means 63. The leading edges of the leftover sheets 67*b* are aligned by the sheet aligning portion 88 acting as the limiting means.

By releasing the holding of the leftover sheets 67*b* by the abutting portion 72*c* and the feed roller 61, the leftover sheets 67*b* are loosened, and the leading edges of the leftover sheets 67*b* can thus be aligned securely by the sheet aligning portion 88 even when the leading edges of the leftover sheets 67*b* are skewed with respect to the sheet feeding direction B. Accordingly, the leftover sheets 67*b* can be set ready for feeding to the transport roller 77 and the pinch roller 78, and the stability of the feed operation of the sheets 67 can thus be improved.

According to the present embodiment, the sheet pressing portion 87 as the sheet separating means and the sheet aligning portion 88 as the limiting means are integrally disposed. The leftover sheets 67*b* are pushed back by the sheet pressing portion 87 toward the upstream side of the separating means 63 along the sheet feeding direction B, and the leading edges of the leftover sheets 67*b* pushed back by the sheet pressing portion 87 are aligned and supported by the sheet aligning portion 88.

Since the sheet pressing portion 87 and the sheet aligning portion 88 are integrally disposed as described above, the leading edges of the leftover sheets can be securely aligned after the leftover sheets 67*b* have been pushed back along the sheet feeding direction B toward the upstream side of the position where the sheets were held between the abutting portion 72*c* and the feed roller 61. As a result, when performing sheet feeding by using the leftover sheets 67*b*, the leftover sheets can be held between the abutting portion and the rotatable feeding means with their leading edges aligned properly.

Furthermore, according to the present embodiment, the common drive shaft member 66 is rotatably supported, to which the sheet pressing portion 87, the separator plate pressing portion 86, and the sheet aligning portion 88 are connected in common, and the sheet pressing portion 87, the separator plate pressing portion 86, and the sheet aligning portion 88 are driven in common by the common drive shaft member 66.

The drive force from the rotational driving source 82 is transmitted to the common drive shaft member 66 by the transmitting means 83. When the drive force from the rotational driving source 82 is transmitted to the common drive shaft member 66 by the transmitting means 83, the common drive shaft member 66 is driven to rotate, and the sheet pressing portion 87, the separator plate pressing portion 86, and the sheet aligning portion 88, connected in common to the common drive shaft member 66, are caused to rotate.

The transmitting means 83 has a partially toothed gear with teeth formed only on a portion of its circumference, that is, the first common input gear 95*a*, and by using this first common input gear 95*a*, the condition in which the drive force from the rotational driving source 82 is transmitted to the common drive shaft member 66 and the condition in which the drive force is not transmitted to the common drive shaft member 66 can be created. With this arrangement, only the drive amount determined by the first common input gear 95*a* can be transmitted to the common drive shaft member 66 by preventing the sheet pressing portion 87, the separator plate pressing portion 86, and the sheet aligning portion 88 from being driven to rotate by the common drive shaft member 66 beyond the predetermined drive amount.

According to the present embodiment, the feed shaft member 65 and the common drive shaft member 66 are each supported rotatably. The feed roller 61 is connected to the feed shaft member 65, while the sheet pressing portion 87, the separator plate pressing portion 86, and the sheet aligning portion 88 are connected in common to the common drive shaft member 66. The sheet pressing portion 87, the separator plate pressing portion 86, and the sheet aligning portion 88 are driven in common by the common drive shaft member 66.

The drive force from the rotational driving source 82 is transmitted by the transmitting means 83 to the feed shaft member 65 and the common drive shaft member 66. When the drive force from the rotational driving source 82 is transmitted by the transmitting means 83 to the feed shaft member 65 and the common drive shaft member 66, the feed shaft member 65 is driven to rotate, causing the feed roller 61 to rotate, and the common drive shaft member 66 is driven to rotate, causing the sheet pressing portion 87, the separator plate pressing portion 86, and the sheet aligning portion 88 to rotate in synchronized fashion.

The transmitting means 83 includes the sun gear 91, the feed input gear 94, the common input gear 95, and the planet gear 92. The sun gear 91 is mounted so as to rotate in an interlocking fashion with the output shaft of the rotational driving source 82, the feed input gear 94 is mounted in an area surrounding the sun gear 91 and rotates in an interlocking fashion with the feed shaft member 65, and the common input gear 95 is mounted in a position circumferentially spaced apart from the feed input gear 94 in the area surrounding the sun gear 91, and rotates in an interlocking fashion with the common drive shaft member 66.

The planet gear 92 is mounted in meshing engagement with the sun gear 91, or more specifically, the second sun gear 91*b*, in such a manner as to be movable around the second sun gear 91*b* between the feed input position 99*a*, where the rotational force is transmitted to the feed input gear 94, and the common input position 99*b*, where the rotational force is transmitted to the common input gear 95, or more specifically, the first common input gear 95*a*.

When the output shaft 82*a* of the rotational driving source 82 rotates, the sun gear 91 rotates in an interlocking fashion with the output shaft 82*a*, causing the planet gear 92 engaged with the second sun gear 91*b* to move around the second sun gear 91*b* into either the feed input position 99*a* or the common input position 99*b*. When the planet gear 92 is moved to the feed input position 99*a*, the planet gear 92 transmits the rotational force to the feed input gear 94 and causes the feed input gear 94 to rotate; the drive force from the rotational driving source 82 can thus be transmitted to the feed shaft member 65. The feed roller 61 can be driven in this way.

When the planet gear 92 is moved to the common input position 99*b*, the planet gear 92 transmits the rotational force to the first common input gear 95*a* and causes the first common input gear 95*a* to rotate; the drive force from the rotational driving source 82 can thus be transmitted to the common drive shaft member 66. In this way, the sheet pressing portion 87, the separator plate pressing portion 86, and the sheet aligning portion 88 can be driven in synchronized fashion.

By moving the planet gear 92 either to the feed input position 99*a* or the common input position 99*b* as described above, either the feed roller 61 or the sheet pressing portion 87, the separator plate pressing portion 86, and the sheet aligning portion 88 can be selected for driving. Since either the feed roller 61 or the sheet pressing portion 87, the separator plate pressing portion 86, and the sheet aligning portion 88, whichever selected, can be reliably operated in this manner, the accuracy and stability of the sheet feeding operation of the sheet feeding apparatus 60 for feeding the sheets 67 can be improved.

Furthermore, since the transmitting means 83 is constructed by simply combining various gears, the size of the sheet feeding apparatus 60 can be reduced, and the reliability of the sheet feeding operation of the sheet feeding apparatus 60 can be improved.

In the present embodiment, the planet gear 92 is constructed so as to transmit the rotational force to the feed input gear 94 via the intermediate gear 93, but alternatively, the planet gear 92 may be constructed so as to engage directly with the feed input gear 94 to transmit the rotational force to it.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A sheet feeding apparatus comprising:

rotatable feeding means for feeding a sheet by rotation thereof;

supporting means, having a supporting portion movable toward and away from the rotatable feeding means, for supporting a plurality of stacked sheets from a side opposite from the rotatable feeding means, and for elastically causing one sheet closest to the rotatable feeding means to contact the rotatable feeding means;

separating means, having an abutting portion movable toward and away from the rotatable feeding means, for elastically holding the sheets between the abutting portion and the rotatable feeding means, and for separating the sheets so as to allow only the one sheet closest to the rotatable feeding means to be fed out with the rotation of the rotatable feeding means, the separating means being disposed downstream of the supporting means in a sheet feeding direction;

sheet separating means for displacing remaining sheets in a direction away from the rotatable feeding means when the one sheet has been advanced to a target position reaching sheet transporting means disposed downstream in the sheet feeding direction;

abutting portion separating means for moving the abutting portion in a direction away from the rotatable feeding means so as to release the holding of the sheets between the abutting portion and the rotatable feeding means when the one sheet has reached the target position; and limiting means for preventing the remaining sheets, excluding the one sheet, from moving downstream in the sheet feeding direction when the one sheet has reached the target position;

wherein the sheet separating means and the limiting means are integrally disposed.

2. The sheet feeding apparatus of claim 1, wherein the sheet separating means is provided adjacent to the rotatable feeding means, and displaces the remaining sheets near the rotatable feeding means by pressing the sheets from a side adjacent to the rotatable feeding means.

3. The sheet feeding apparatus of claim 1, wherein the limiting means aligns leading edges of leftover sheets which are sheets fed to the separating means from the remaining sheets by the rotatable feeding means and separated from the one sheet by the separating means.

4. The sheet feeding apparatus of claim 3, wherein the sheet separating means pushes back leftover sheets upstream of the separating means in the sheet feeding direction; and the limiting means aligns and supports the leading edges of the leftover sheets pushed back by the sheet separating means.

5. The sheet feeding apparatus of claim 1, further comprising:

a common drive shaft member rotatably supported, for driving in common the sheet separating means, the abutting portion separating means, and the limiting means which are connected together;

a rotational driving source; and transmitting means for transmitting a drive force from the rotational driving source to the common drive shaft member, the transmitting means having a partially toothed gear with teeth formed only on a portion of a circumference thereof.

6. The sheet feeding apparatus of claim 1, further comprising:

a feed shaft member rotatably supported, the rotatable feeding means being connected thereto;

a common drive shaft member rotatably supported, for driving in common the sheet separating means, the abutting portion separating means, and the limiting means which are connected thereto together;

a rotational driving source; and transmitting means for transmitting a drive force from the rotational driving source to the feed shaft member and the common drive shaft member, the transmitting means having a sun gear which rotates in an interlocking fashion with an output shaft of the rotational driving source, a feed input gear which is mounted in an area surrounding the sun gear and rotates in an interlocking fashion with the feed shaft member, a common input gear which is mounted in the area surrounding the sun gear and in a position circumferentially spaced apart from the feed input gear and rotates in an interlocking fashion with the common drive shaft member, and a planet gear which is in meshing engagement with the sun gear, and the planet gear being mounted so as to be movable around the sun gear between a feed input position, where rotational force is transmitted to the feed input gear, and a common input position, where rotational force is transmitted to the common input gear.

* * * * *